US010633916B2

(12) United States Patent
Huang et al.

(10) Patent No.: US 10,633,916 B2
(45) Date of Patent: Apr. 28, 2020

(54) WINDOW SHADE AND ACTUATING SYSTEM THEREOF

(71) Applicant: Teh Yor Co., Ltd., Taipei (TW)

(72) Inventors: Chin-Tien Huang, New Taipei (TW); Chien-Lan Huang, New Taipei (TW)

(73) Assignee: Teh Yor Co., Ltd., Taipei (TW)

( * ) Notice: Subject to any disclaimer, the term of this patent is extended or adjusted under 35 U.S.C. 154(b) by 98 days.

(21) Appl. No.: 15/706,864

(22) Filed: Sep. 18, 2017

(65) Prior Publication Data

US 2018/0080278 A1 Mar. 22, 2018

(30) Foreign Application Priority Data

Sep. 19, 2016 (TW) ..... 105130221 A

(51) Int. Cl.
*E06B 9/325* (2006.01)
*E06B 9/60* (2006.01)
(Continued)

(52) U.S. Cl.
CPC ..... *E06B 9/325* (2013.01); *E06B 9/322* (2013.01); *E06B 9/34* (2013.01); *E06B 9/60* (2013.01);
(Continued)

(58) Field of Classification Search
CPC ... E06B 9/325; E06B 9/60; E06B 9/34; E06B 9/322; E06B 2009/2435; E06B 2009/3222; E06B 9/90; E06B 2009/801
See application file for complete search history.

(56) References Cited

U.S. PATENT DOCUMENTS 4,476,910 A 10/1984 Saito
4,884,618 A * 12/1989 Steeves ..... E06B 9/60 160/321
(Continued)

FOREIGN PATENT DOCUMENTS

JP 2014-525529 A 9/2014
KR 10-2014-0065430 A 5/2014
(Continued)

OTHER PUBLICATIONS

The Office Action dated Oct. 18, 2017 in corresponding Taiwan Patent Application No. 105130221.
(Continued)

*Primary Examiner* — Katherine W Mitchell
*Assistant Examiner* — Abe Massad
(74) *Attorney, Agent, or Firm* — Chen Yoshimura LLP

(57) ABSTRACT

An actuating system for a window shade includes a fixed support shaft, a rotary drum pivotally connected with the support shaft, the rotary drum being rotatable for winding or unwinding a shading structure, and a limiting mechanism disposed inside the rotary drum and including a threaded portion provided on the support shaft, a stop portion, a limiting part, and a follower engaged with the threaded portion, the stop portion and the limiting part being respectively disposed adjacent to a first and a second end of the threaded portion, and the follower being rotationally coupled to and slidable relative to the rotary drum. The rotary drum is rotatable in a first direction to drive the follower to slide toward a first position for engagement with the limiting part, and in an opposite second direction to drive the follower to slide toward a second position for engagement with the stop portion.

27 Claims, 37 Drawing Sheets

(51) Int. Cl.

| | |
|---|---|
| ***E06B 9/322*** | (2006.01) |
| ***E06B 9/34*** | (2006.01) |
| *E06B 9/24* | (2006.01) |

(52) U.S. Cl.

CPC ..... *E06B 2009/2435* (2013.01); *E06B 2009/3222* (2013.01)

(56) References Cited

U.S. PATENT DOCUMENTS

| | | | | |
|---|---|---|---|---|
| 6,435,252 | B2 * | 8/2002 | Colson | E06B 9/32 160/121.1 |
| 6,782,938 | B2 * | 8/2004 | Colson | E06B 9/32 160/121.1 |
| 9,243,447 | B2 * | 1/2016 | MacDonald | E06B 9/50 |
| 9,353,570 | B2 * | 5/2016 | Smith | E06B 9/38 |
| 9,739,089 | B2 * | 8/2017 | Smith | E06B 9/60 |
| 2004/0123957 | A1 | 7/2004 | Wen et al. | |
| 2014/0216666 | A1 | 8/2014 | Smith et al. | |
| 2015/0376941 | A1 * | 12/2015 | Fujita | E06B 9/26 160/241 |
| 2016/0258211 | A1 * | 9/2016 | Smith | E06B 9/38 |
| 2018/0328106 | A1 | 11/2018 | Smith et al. | |

FOREIGN PATENT DOCUMENTS

| | | | |
|---|---|---|---|
| KR | 10-2015-0125950 | A | 11/2015 |
| TW | 549349 | | 12/1991 |
| WO | 2013005524 | A1 | 1/2013 |
| WO | 2013033014 | A1 | 3/2013 |
| WO | 2014142790 | A1 | 9/2014 |
| WO | 2014143057 | A1 | 9/2014 |
| WO | 2016118219 | A1 | 7/2016 |

OTHER PUBLICATIONS

Japanese Office Action, dated Oct. 1, 2019 in a counterpart Japanese patent application, No. JP 2018-547957.

Korean Office Action, dated Sep. 11, 2019 in a counterpart application KR 10-2018-7025295.

The International Search Report and Written Opinion in co-pending PCT Appl. No. PCT/US2017/051991 dated Mar. 19, 2018.

Indian Office Action, dated Dec. 26, 2019, in a counterpart Indian patent application, No. IN 201817027979.

* cited by examiner

WINDOW SHADE AND ACTUATING SYSTEM THEREOF

CROSS-REFERENCE TO RELATED APPLICATION(S)

This Patent Application claims priority to Taiwan Patent Application No. 105130221 filed on Sep. 19, 2016, which is incorporated herein by reference.

BACKGROUND

1. Field of the Invention

The present invention relates to window shades, and actuating systems used in window shades.

2. Description of the Related Art

Many types of window shades are currently available on the market, such as Venetian blinds, honeycomb shades, roller shades, shades having two panel assemblies, etc. With respect to a shade having two panels, the shading assembly comprised of the two panels is usually connected with a rotary drum, and a user can typically operate a cord for driving the rotary drum in rotation so that the shading assembly can wind around the rotary drum or unwind from the rotary drum.

A disadvantage of the aforementioned construction is that it may require a cord of an excessive length, which may affect the outer appearance of the window shade. Moreover, there is the risk of child strangle on the longer cord. To remedy those disadvantages, an existing approach may use a spring assembly for driving the rotary drum, and a user can directly grasp a bottom part of the shading assembly to adjust its height without the need of operating cords. This approach, however, uses a control system that is strictly adapted to operate for the specific length and weight of the shading assembly, and needs to be modified in accordance with the size of the shading assembly.

Therefore, there is a need for a window shade that is convenient to operate, and address or improve at least the foregoing issues.

SUMMARY

The present application describes a window shade and an actuating system for use with the window shade.

According to one embodiment, the window shade includes a head rail fixedly connected with a support shaft, a shading structure, a rotary drum, a bottom part, a spring unit and a limiting mechanism. The shading structure includes a first and a second suspending part, each of which respectively having a first end and a second end opposite to each other. The rotary drum is pivotally connected with the support shaft, and is respectively affixed with the first ends of the first and second suspending parts, the rotary drum being rotatable in a first direction for winding the shading structure around the rotary drum and in a second direction opposite to the first direction for unwinding the shading structure from the rotary drum. The bottom part is respectively connected with the second ends of the first and second suspending parts. The spring unit is connected with the rotary drum, and is operable to bias the rotary drum in rotation in the first direction. The limiting mechanism is respectively connected with the support shaft and the rotary drum, and has an unlocking state and a locking state, the unlocking state of the limiting mechanism allowing rotation of the rotary drum in the first and second directions, and the locking state of the limiting mechanism preventing rotation of the rotary drum in the first direction, wherein the limiting mechanism is switchable from the unlocking state to the locking state by a limited rotational displacement of the rotary drum in the second direction while the shading structure is fully extended from the rotary drum.

According to an embodiment, an actuating system for a window shade includes a fixed support shaft, a rotary drum pivotally connected with the support shaft and connectible with a shading structure, the rotary drum being rotatable for winding or unwinding the shading structure, and a limiting mechanism disposed inside the rotary drum and including a threaded portion, a stop portion, a limiting part, and a follower engaged with the threaded portion, the threaded portion being provided on the support shaft, the stop portion and the limiting part being respectively disposed adjacent to a first and a second end of the threaded portion, and the follower being rotationally coupled to the rotary drum and slidable relative to the rotary drum. The rotary drum is rotatable in a first direction to drive the follower to slide toward a first position for engagement with the limiting part, and in an opposite second direction to drive the follower to slide toward a second position for engagement with the stop portion.

DETAILED DESCRIPTION OF THE EMBODIMENTS

Figure 1:
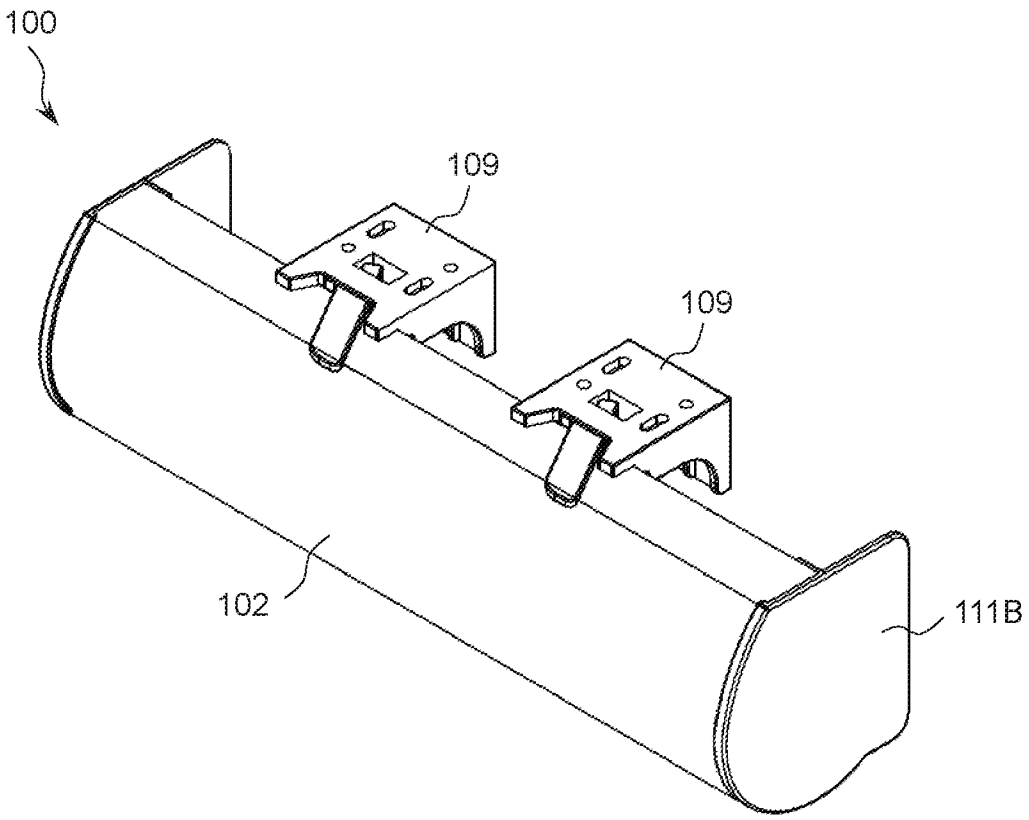
FIG. 1 is a perspective view illustrating an embodiment of a window shade in a fully raised or retracted state.
Figure 2:
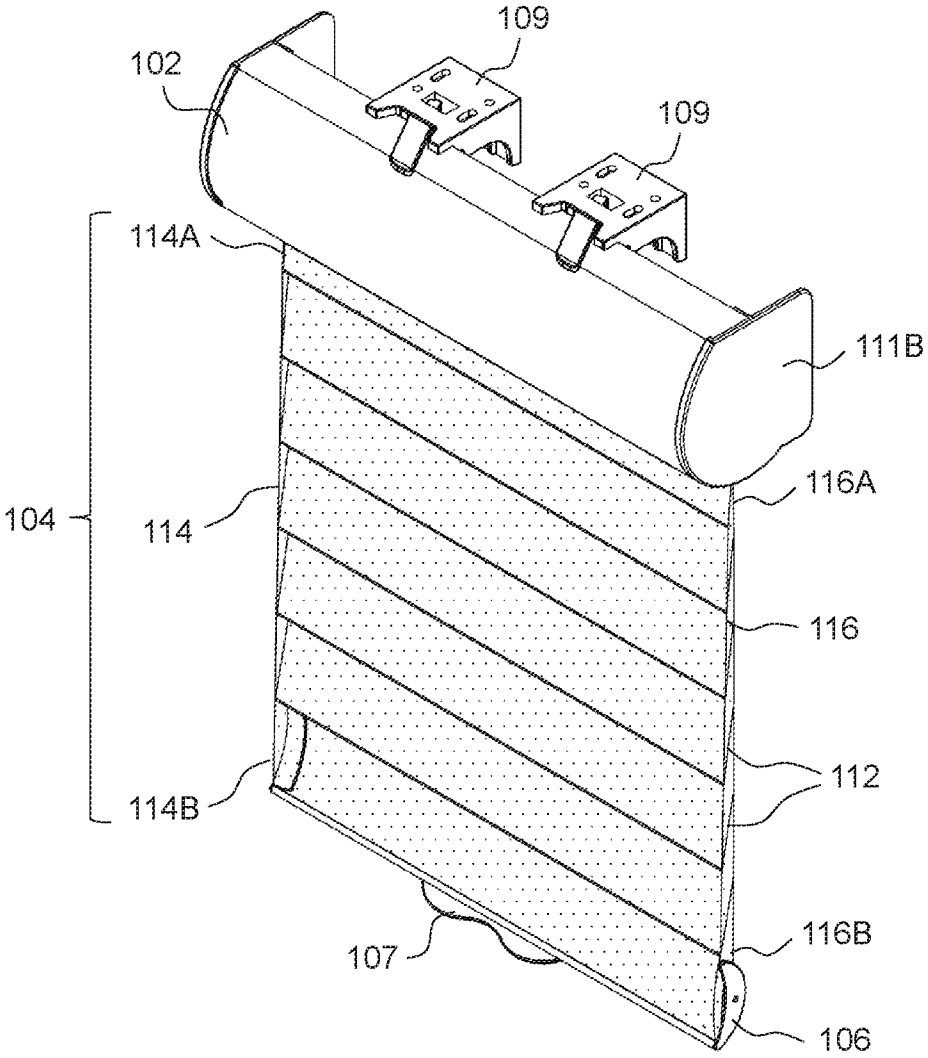
FIG. 2 is a perspective view illustrating the window shade in a fully lowered and closed state.
Figure 3:
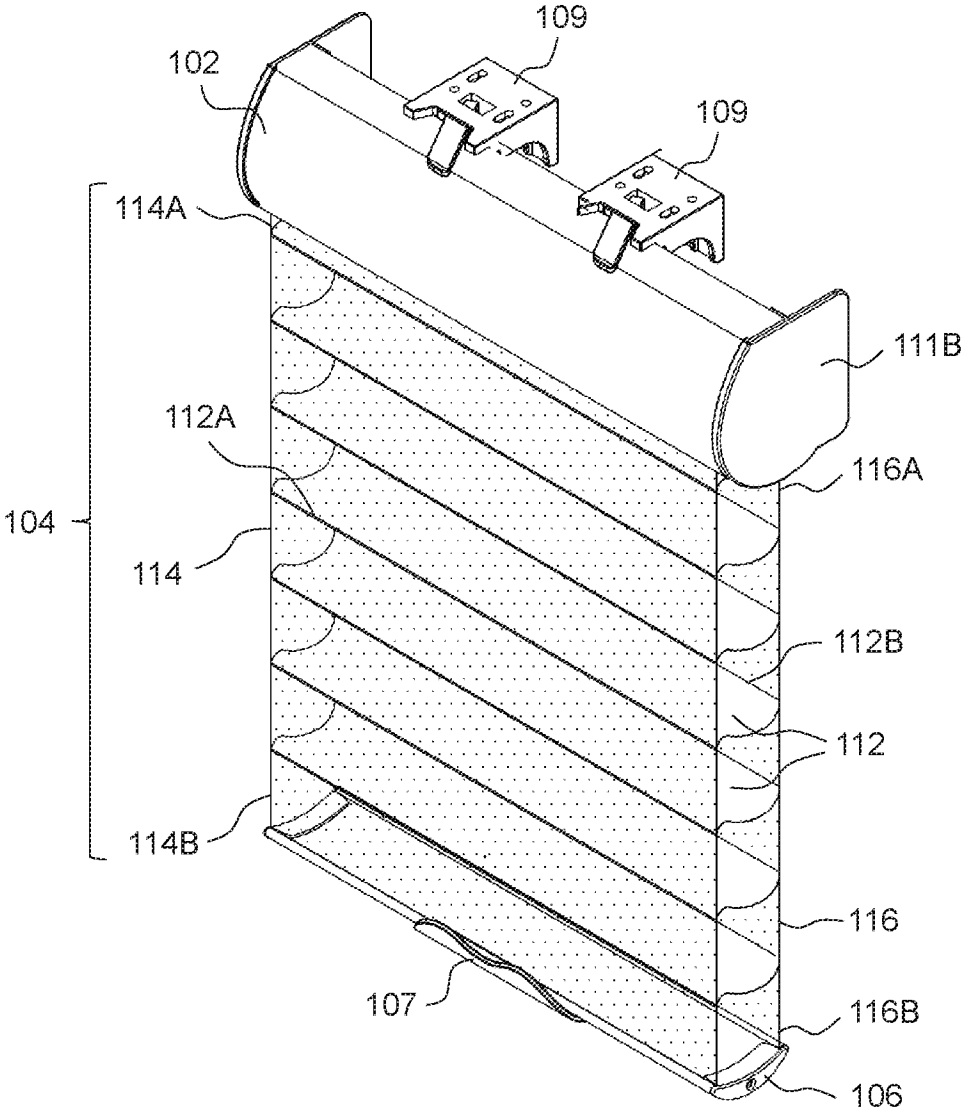
FIG. 3 is a perspective view illustrating the window shade in a fully lowered and open state.
Figure 4:
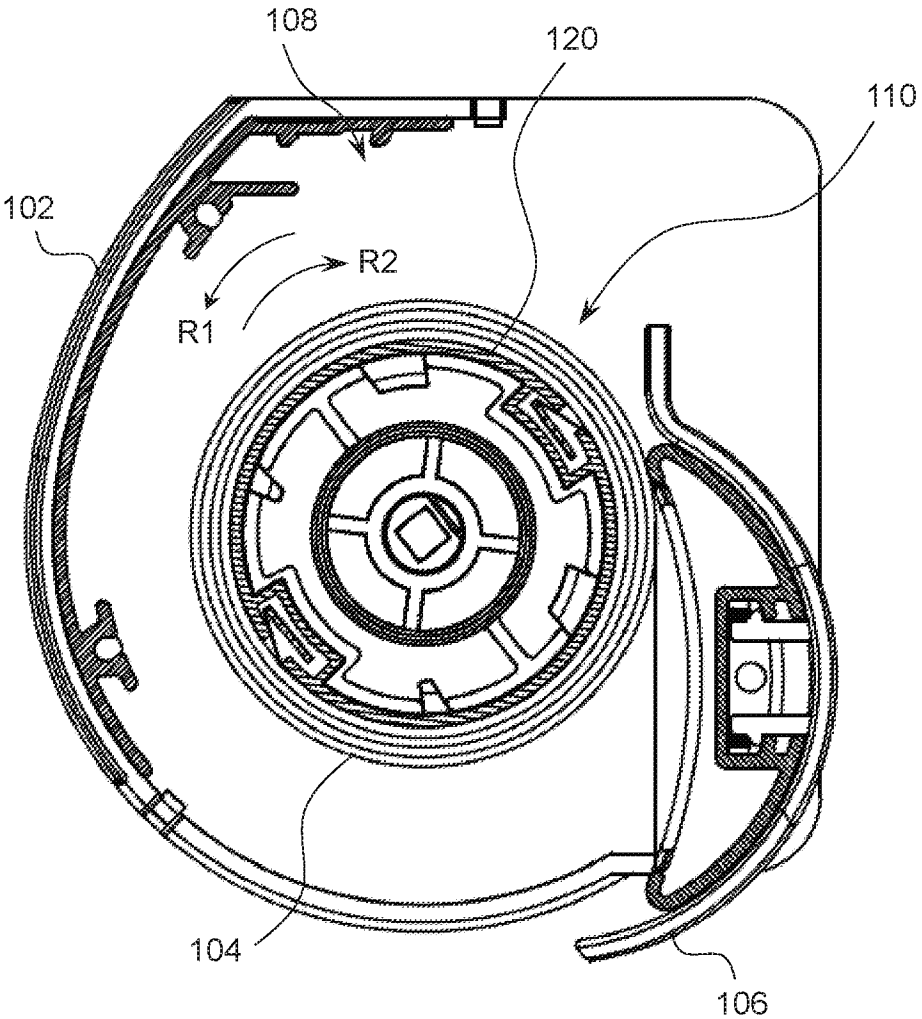
FIG. 4 is a schematic view illustrating an actuating system provided in the window shade.

FIG. 1 is a perspective view illustrating an embodiment of a window shade 100 in a fully raised or retracted state, FIG. 2 is a perspective view illustrating the window shade 100 in a fully lowered and closed state, FIG. 3 is a perspective view illustrating the window shade 100 in a fully lowered and open state, and FIG. 4 is a schematic view illustrating an actuating system 110 provided in the window shade 100. Referring to FIGS. 1-4, the window shade 100 can include a head rail 102, a shading structure 104, and a bottom part 106 disposed at a bottom of the shading structure 104. The window shade 100 described herein can be a cordless shade that can be operated and adjusted with the bottom part 106 during use.

The head rail 102 may be of any types and shapes. The head rail 102 may be affixed at a top of a window frame via one or more attachment bracket 109, and the shading structure 104 and the bottom part 106 can be suspended from the head rail 102. Moreover, the head rail 102 can have a cavity 108 in which the actuating system 110 can be installed for controlling upward and downward movements of the shading structure 104 and the bottom part 106.

The shading structure 104 can include a plurality of transversal vanes 112 and two suspending parts 114 and 116. Each of the transversal vanes 112 can have an elongate shape and extend generally horizontally. Examples of materials for the transversal vanes 112 can include flexible materials, such as fabric materials, plastic strips, etc. The transversal vanes 112 can be distributed generally parallel to one another along a length of the two suspending parts 114 and 116 with the two longitudinal edges 112A and 112B of each transversal vane 112 respectively attached to the two suspending parts 114 and 116.

The two suspending parts 114 and 116 can be made of soft materials, which can include, without limitation, fabric materials and plastic strips. The two suspending parts 114 and 116 may take any suitable forms, which can include, without limitation, panels, cords, strips, etc. In the illustrated embodiment, the two suspending parts 114 and 116 are exemplary two panels, and the two longitudinal edges 112A and 112B of each transversal vane 112 can be respectively connected with the two panels. According to another embodiment, the two suspending parts 114 and 116 can be suspending cords or strips, and the two longitudinal edges 112A and 112B of each transversal vane 112 can be respectively connected with the suspending cords or strips. The suspending part 114 can have two opposite ends 114A and 114B, and the suspending part 116 can have two opposite ends 116A and 116B. The respective ends 114A and 116A of the suspending parts 114 and 116 can be connected with the actuating system 110, and the respective ends 114B and 116B of the suspending parts 114 and 116 can be attached to the bottom part 106.

The actuating system 110 is operable to wind the shading structure 104 inside the head rail 102 or to unwind the shading structure 104 so that it can expand vertically downward from the head rail 102. Moreover, the actuating system 110 can be further operable to impart a relative displacement between the two suspending parts 114 and 116 for adjusting an angular position of the transversal vanes 112. According to an embodiment, the transversal vanes 112 and the suspending parts 114 and 116 can have different light transmission rates. For example, the transversal vanes 112 may be less transparent and more opaque than the suspending parts 114 and 116, and the degree of light passage through the shading structure 104 can be adjusted by changing the angular position of the transversal vanes 112. When the transversal vanes 112 are positioned generally vertically, the transversal vanes 112 can prevent light passage through the shading structure 104, which can correspond to the closed state shown in FIG. 2. In contrast, when the transversal vanes 112 are positioned generally horizontally, light passage through the shading structure 104 can be allowed at gaps between the transversal vanes 112, which can correspond to the open state shown in FIG. 3.

The bottom part 106 is disposed at a bottom of the shading structure 104, and can have a front and a rear side respectively attached to the ends 114B and 116B of the suspending parts 114 and 116. According to an example of construction, the bottom part 106 may include an elongated rail. However, any weighing structures may be suitable. According to an embodiment, the bottom part 106 may further be affixed with a handle 107 for facilitating manual operation of the bottom part 106.

Figure 5:
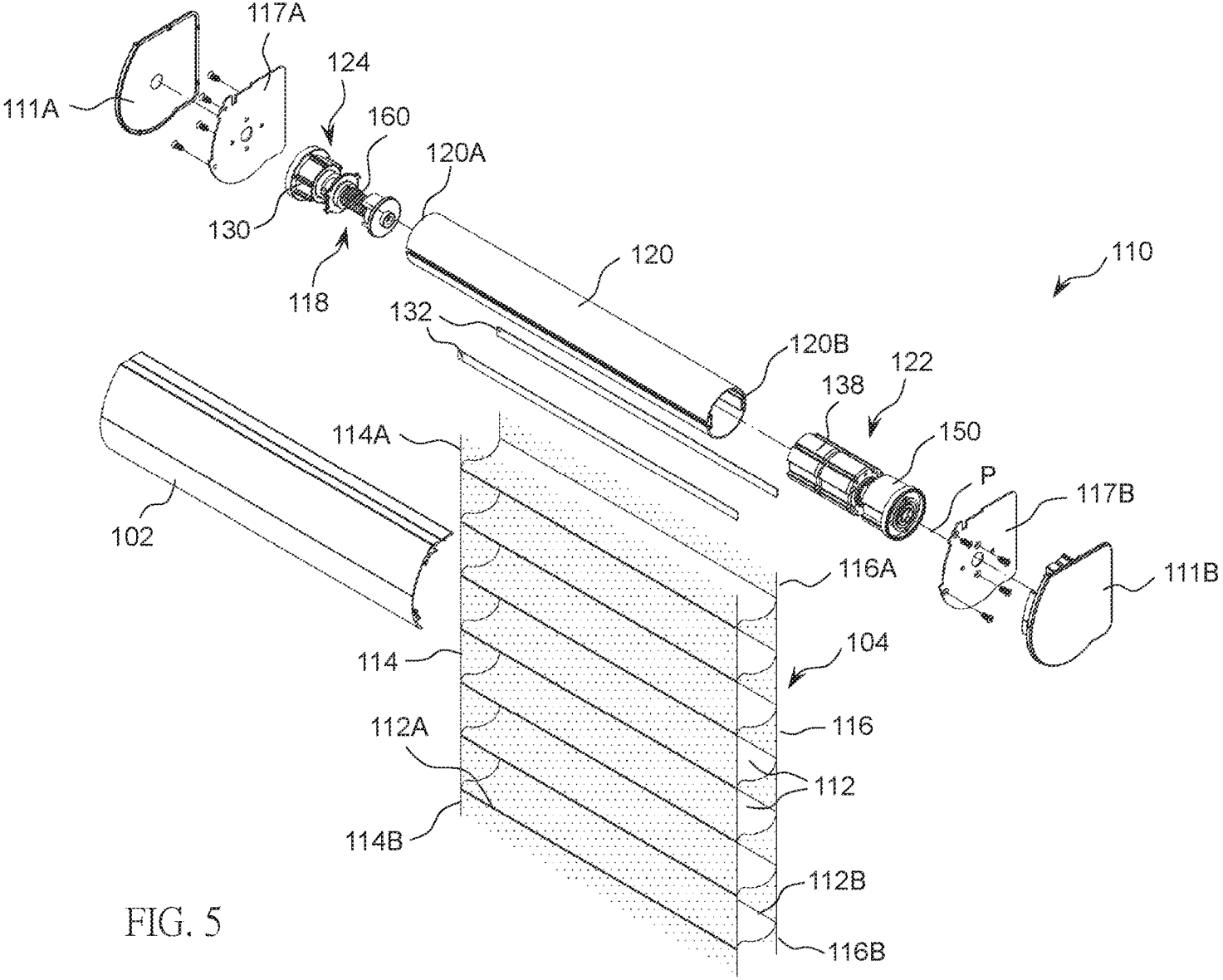
FIG. 5 is an exploded view illustrating a construction of the actuating system.
Figure 6:
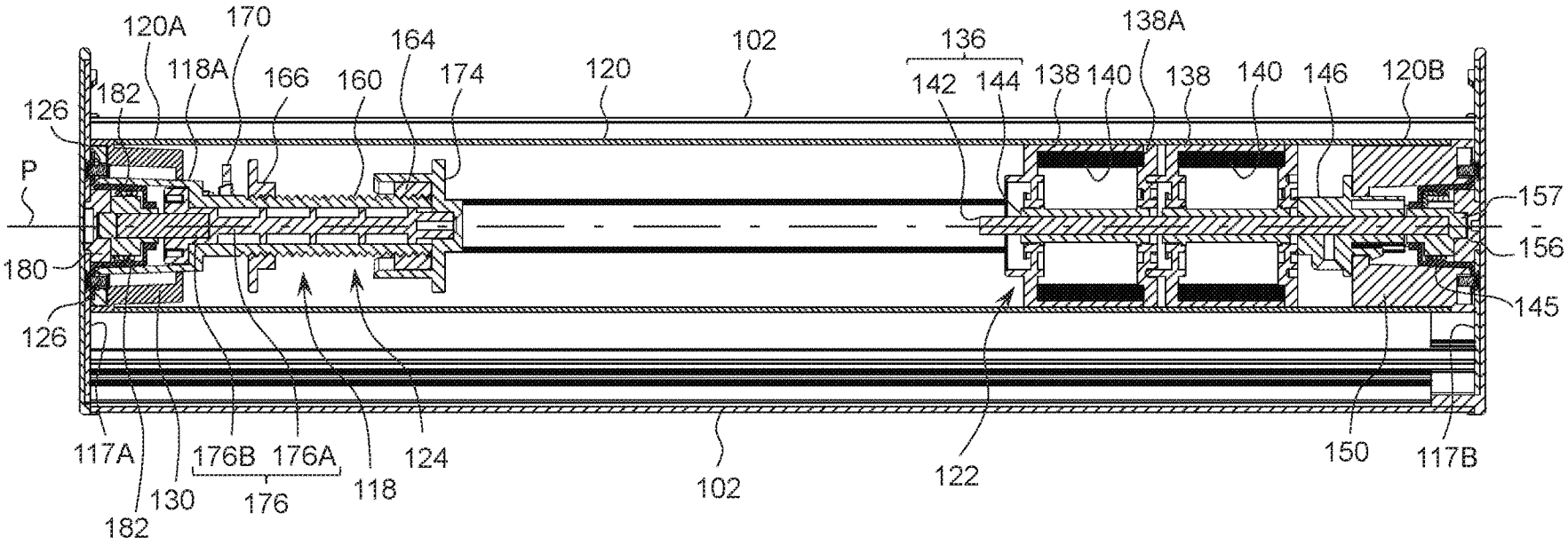
FIG. 6 is a cross-sectional view illustrating the actuating system.

In conjunction with FIGS. 1-4, FIG. 5 is an exploded view illustrating a construction of the actuating system 110, and FIG. 6 is a cross-sectional view illustrating the actuating system 110. Referring to FIGS. 5 and 6, the head rail 102 can include two support brackets 117A and 117B fixedly attached at two opposite ends of the head rail 102, and the actuating system 110 can be assembled inside the head rail 102 between the two support brackets 117A and 117B. Moreover, the head rail 102 can further include two end caps 111A and 111B that respectively cover an outer side of the two support brackets 117A and 117B for offering a more appealing appearance to the head rail 102. The actuating system 110 can include a stationary support shaft 118, a rotary drum 120, a spring unit 122 and a limiting mechanism 124.

The support shaft 118 can be fixedly connected with the head rail 102. For example, the support shaft 118 may be fixedly attached to the support bracket 117A of the head rail 102 via a fastener 126. In this manner, the support shaft 118 cannot rotate and constantly remains stationary in the head rail 102.

The rotary drum 120 can have two opposite ends 120A and 120B, and the support shaft 118 can be inserted into a hollow interior of the rotary drum 120 through the end 120A thereof such that the rotary drum 120 is pivotally connected with the support shaft 118 about a pivot axis P. According to an example of construction, the support shaft 118 can have an enlarged portion 118A, and the end 120A of the rotary drum 120 can be assembled with a bearing 130 that is pivotally connected with the enlarged portion 118A. The enlarged portion 118A can thereby provide pivotal support for the rotary drum 120 at the end 120A.

Figure 7:
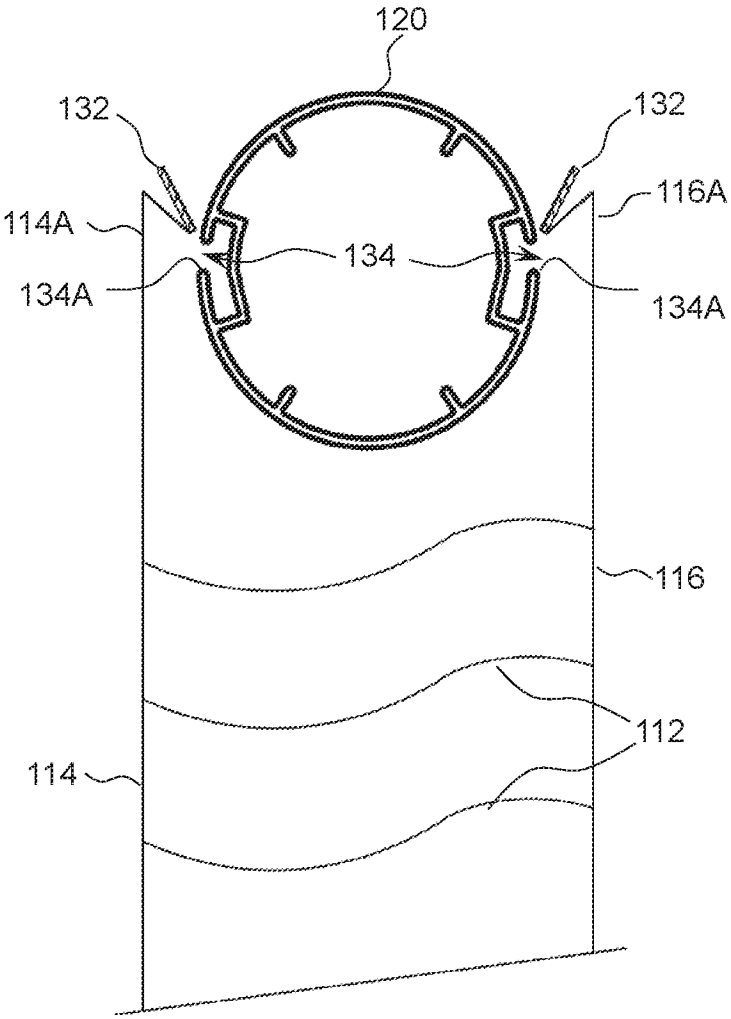
FIGS. 7-9 are schematic views illustrating an example of implementation for connecting the ends of suspending parts with a rotary drum in the actuating system.
Figure 8:
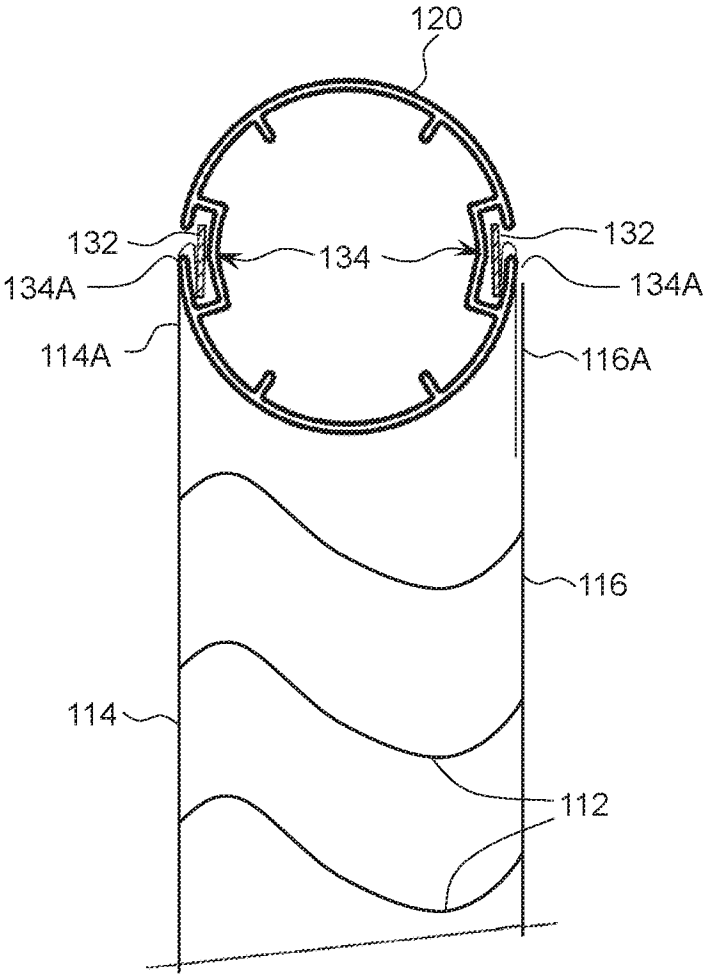
Figure 9:
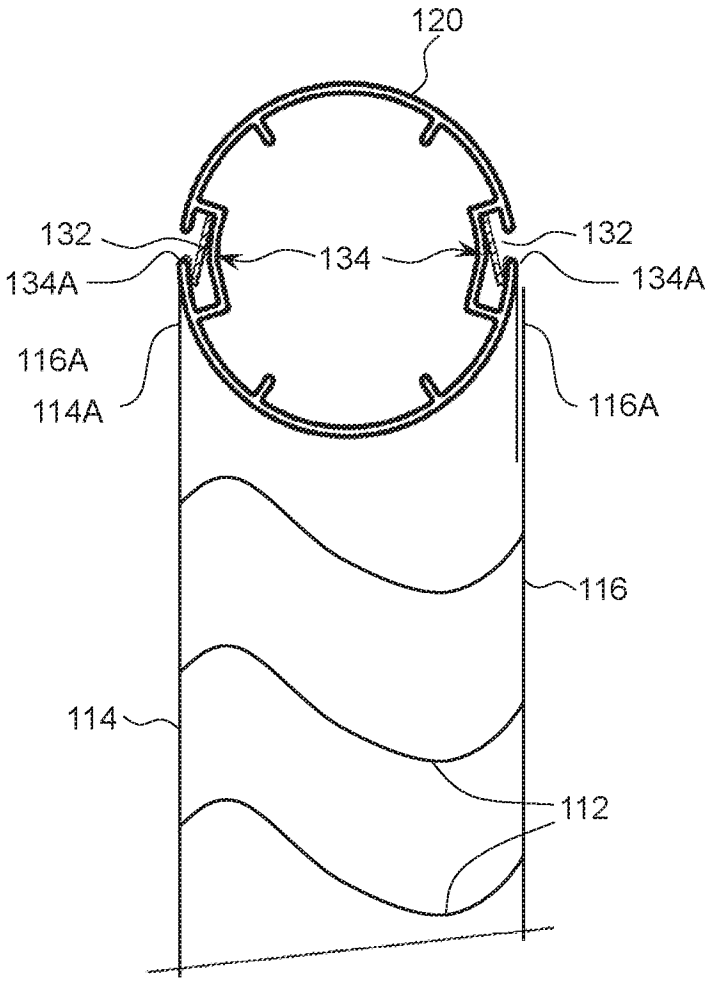
Figure 10:
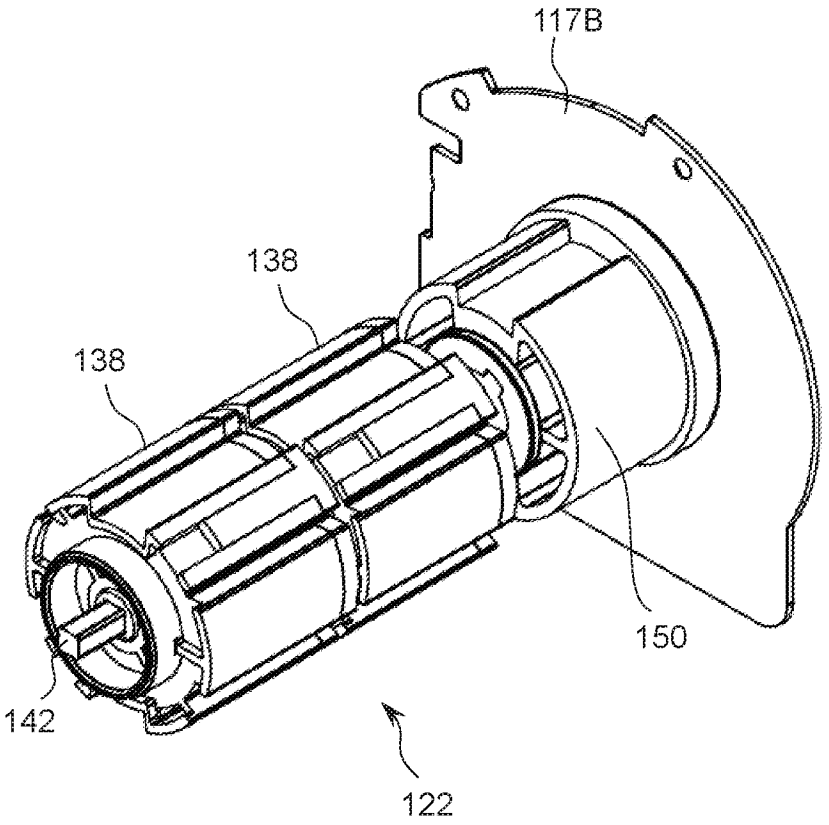
FIGS. 10 and 11 are two perspective views illustrating a spring unit of the actuating system under two different angles of view.
Figure 11:
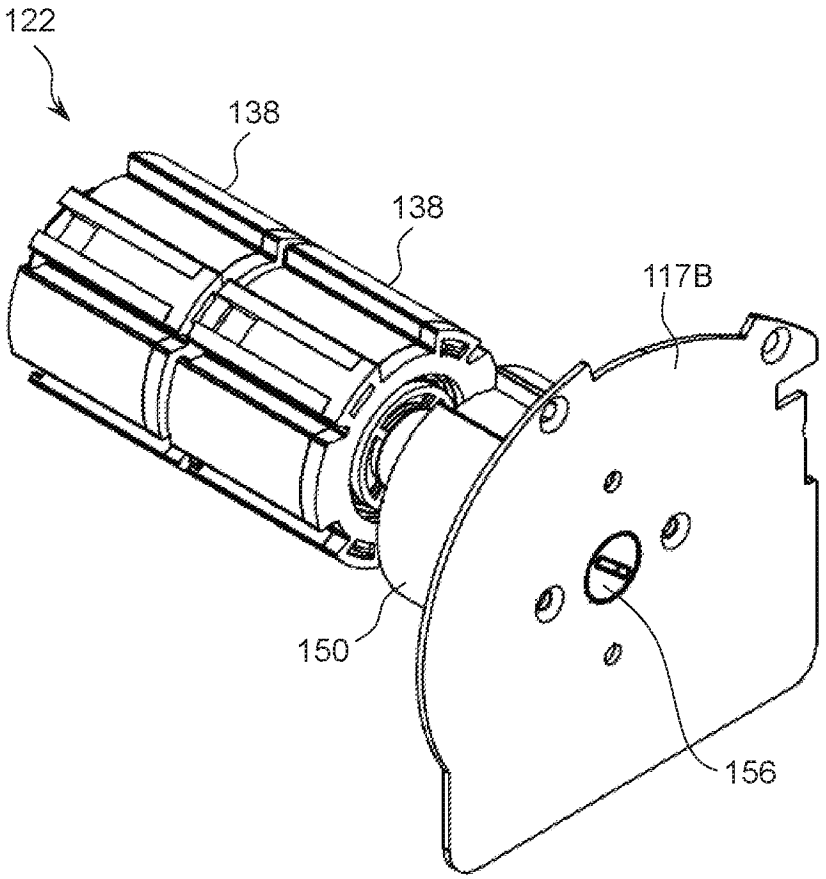

The rotary drum 120 can be respectively affixed with the ends 114A and 116A of the suspending parts 114 and 116. For example, the ends 114A and 116A of the suspending parts 114 and 116 may be connected with the rotary drum 120 at two diametrically opposite locations. FIGS. 7-9 are schematic views illustrating an example of implementation for connecting the ends 114A and 116A of the suspending parts 114 and 116 with the rotary drum 120. Referring to FIGS. 7-9, the end 114A of the suspending part 114 may be affixed with an anchor strip 132, and a peripheral surface of the rotary drum 120 can include a slot 134 having an opening 134A that is smaller than a width of the anchor strip 132. For attaching the end 114A of the suspending part 114 to the rotary drum 120, a portion of the suspending part 114 first can be folded over the anchor strip 132. As shown in FIG. 8 the anchor strip 132 and the folded portion of the suspending part 114 can be inserted into the slot 134 with the remaining suspending part 114 extending outside the slot 134. Then the suspending part 114 can be pulled away from the rotary drum 120, which causes the folded portion of the suspending part 114 to push the anchor strip 132 upward inside the slot 134, whereby the anchor strip 132 can be securely retained in the slot 134 as shown in FIG. 9. The end 116A of the suspending part 116 can be attached to the rotary drum 120 in a same way.

Referring to FIG. 4, a rotation of the rotary drum 120 in a first or winding direction R1 can wind the shading structure 104 around the rotary drum 120 and raise the bottom part 106, and a rotation of the rotary drum 120 in a second or unwinding direction R2 opposite to R1 can cause the shading structure 104 to unwind and expand from the rotary drum 120 and lower the bottom part 106. While the bottom part 106 moves vertically, the shading structure 104 can remain in the closed state with the transversal vanes 112 generally vertical and the two suspending parts 114 and 116 adjacent to each other.

Figure 12:
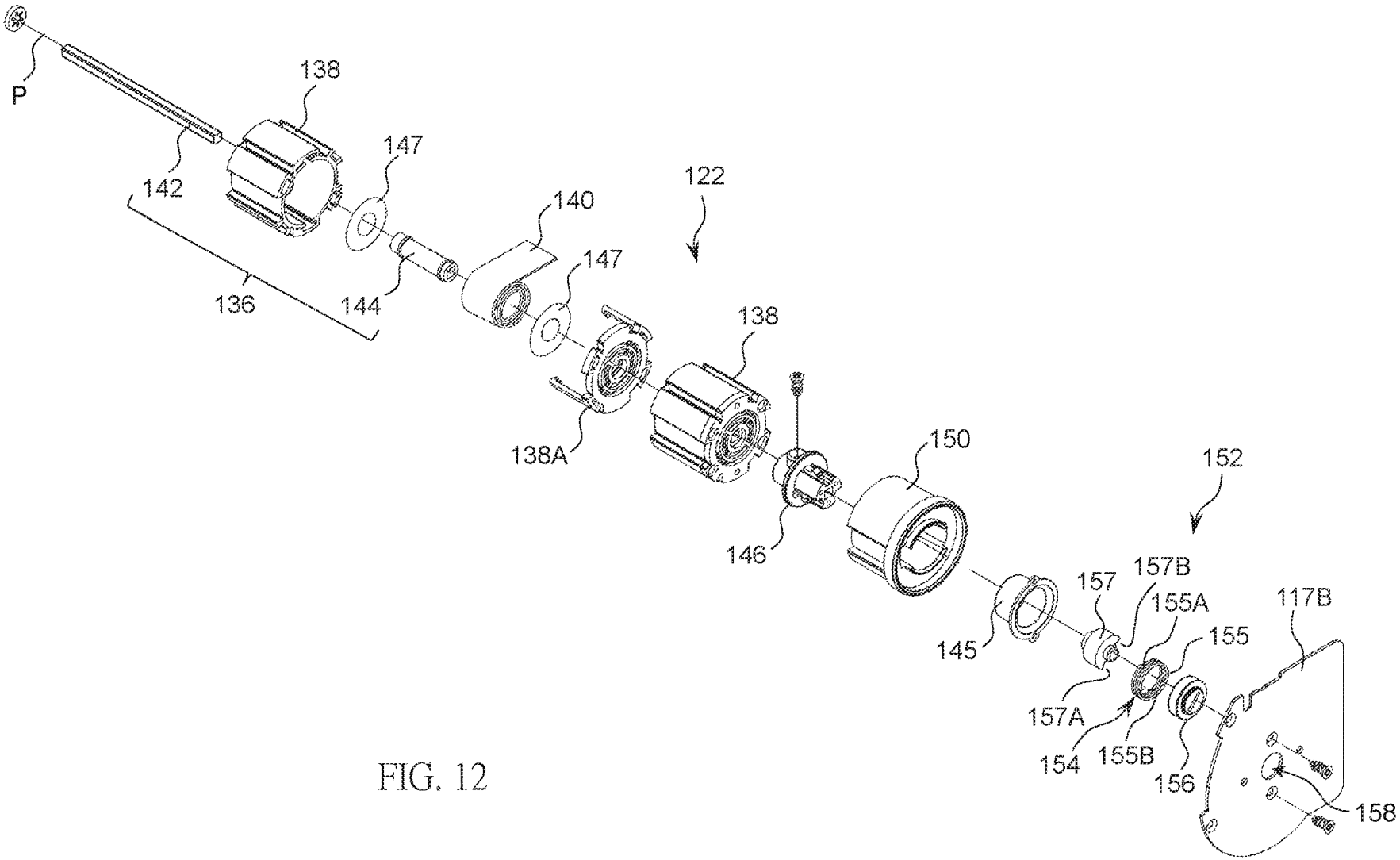
FIG. 12 is an exploded view illustrating the spring unit.
Figure 13:
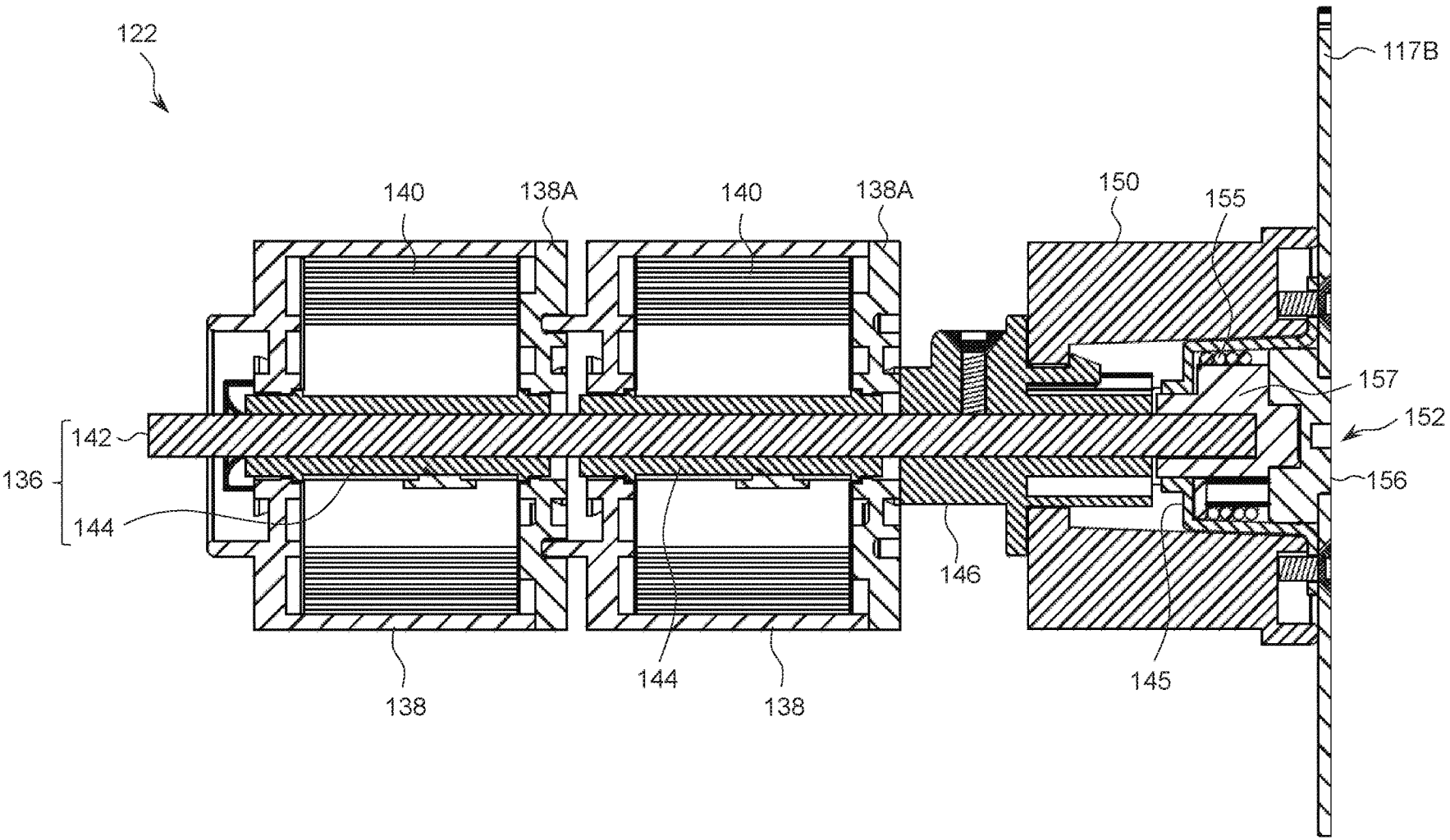
FIG. 13 is a cross-sectional view illustrating the spring unit.

In conjunction with FIGS. 5 and 6, FIGS. 10 and 11 are perspective views illustrating the spring unit 122 under two different angles of view, FIG. 12 is an exploded view illustrating the spring unit 122, and FIG. 13 is a cross-sectional view illustrating the spring unit 122. Referring to FIGS. 5, 6 and 10-13, the spring unit 122 can be disposed adjacent to the support bracket 117B of the head rail 102 and can be connected with the rotary drum 120. The spring unit 122 can bias the rotary drum 120 in rotation for winding the shading structure 104 when a user manually raises the bottom part 106. Moreover, the biasing force applied by the spring unit 122 can assist in keeping the bottom part 106 stationary at any desirable position relative to the head rail 102. The spring unit 122 can include a shaft assembly 136, one or more housing portion(s) 138 and one or more torsion spring(s) 140.

The shaft assembly 136 can include a shaft 142 extending through the housing portion(s) 138, one or more spring bearing(s) 144 and a coupling part 146. The shaft 142 can be assembled adjacent to the support bracket 117B of the head rail 102, and can extend along the pivot axis P substantially coaxial to the support shaft 118. The shaft 142 can remain stationary during upward and downward displacements of the shading structure 104. According to an example of construction, a fixed socket 145 may be fixedly attached to the support bracket 117B of the head rail 102, and an end of the shaft 142 may be fixedly assembled through the fixed socket 145. The fixed socket 145 can thereby support an end of the shaft assembly 136.

The spring bearing(s) 144 can be fixedly connected with the shaft 142 in a coaxial manner, so that the spring bearing(s) 144 and the shaft 142 are rotationally coupled to one another. The coupling part 146 can be fixedly attached to the shaft 142 axially spaced apart from the spring bearing(s) 144. The coupling part 146 and the shaft 142 can be thereby rotationally coupled to each other.

The housing portion(s) 138 can be pivotally connected with the shaft 142, and can accordingly rotate relative to the shaft assembly 136. According to an example of construction, each housing portion 138 may be associated with one torsion spring 140, so that the number of the housing portion(s) 138 provided in the spring unit 122 correspond to that of the torsion spring(s) 140. For example, the spring unit 122 can include two torsion springs 140, and two housing portions 138 respectively enclosing the two torsion springs 140. Moreover, the housing portions 138 are connected with each other so that they can rotate in unison.

Each torsion spring 140 can be disposed in one housing portion 138, and can coil around the shaft assembly 136. More specifically, a first end of the torsion spring 140 can be attached to the housing portion 138, and a second end of the torsion spring 140 can be attached to the spring bearing 144 of the shaft assembly 136 associated therewith. For facilitating the assembly of the torsion spring 140, the housing portion 138 may have a side opening through which the torsion spring 140 may be disposed inside the housing portion 138, this side opening being closed with a side cover 138A after assembly of the torsion spring 140 inside the housing portion 138. Moreover, two washers 147 may be disposed at a left and a right of the torsion spring 140 to prevent its sideways displacement.

The end 120B of the rotary drum 120 can be connected with a coupling bearing 150, which in turn can be pivotally connected with the fixed socket 145. Accordingly, the fixed socket 145 can pivotally support the end 120B of the rotary drum 120. The spring unit 122 can be placed in a hollow interior of the rotary drum 120 with each housing portion 138 rotationally coupled to an inner surface of the rotary drum 120. Accordingly, the housing portion(s) 138 and the rotary drum 120 can rotate in unison relative to the shaft assembly 136.

Figure 15:
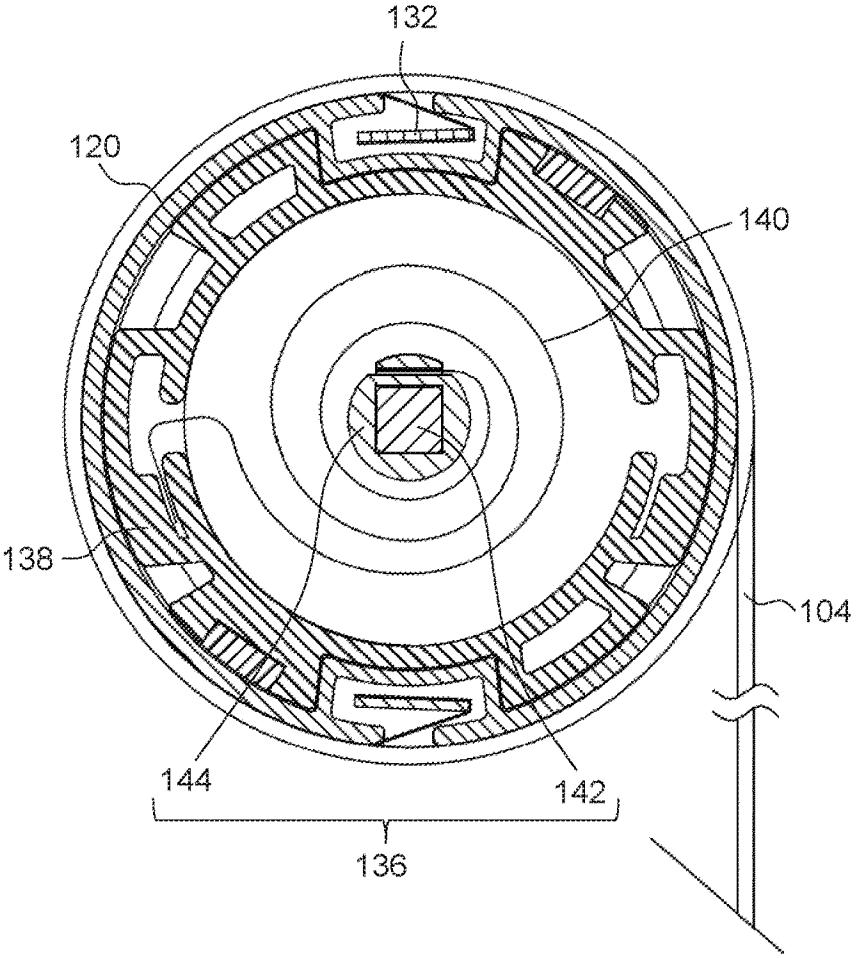
FIG. 15 is a schematic view illustrating the torsion spring of the spring unit when most of the shading structure is unwound from the rotary drum.
Figure 14:
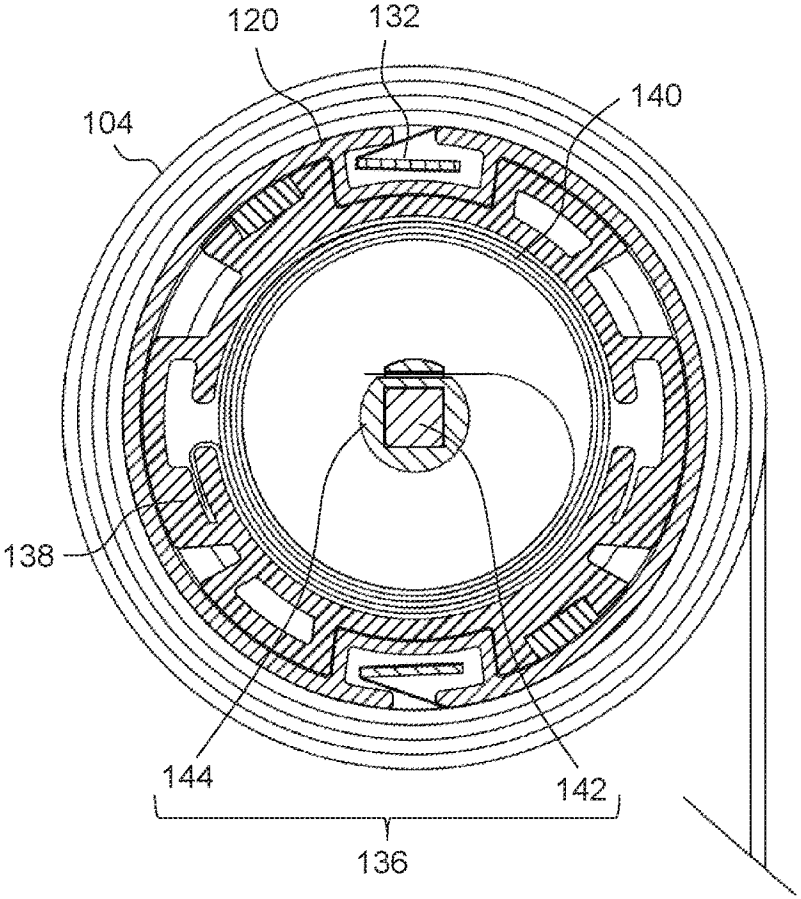
FIG. 14 is a schematic view illustrating a torsion spring of the spring unit when most of the shading structure is wound around the rotary drum.

In use, the biasing force applied by the torsion spring(s) 140 can counteract the weight of the shading structure 104 and bottom part 106 to assist in keeping the shading structure 104 and the bottom part 106 stationary at any height. Moreover, when a user raises the bottom part 106, the torque applied by the torsion spring(s) 140 can urge the housing portion(s) 138 and the rotary drum 120 to rotate in unison relative to the shaft assembly 136 for winding the shading structure 104. FIG. 14 illustrates a configuration of one torsion spring 140 when most of the shading structure 104 is wound around the rotary drum 120, and FIG. 15 illustrates another configuration of the torsion spring 140 when most of the shading structure 104 is unwound from the rotary drum 120. As shown in FIG. 14, the coils of the torsion spring 140 can be adjacent to one another and generally positioned close to an inner wall of the housing portion 138 when most of the shading structure 104 is wound around the rotary drum 120. In contrast, as shown in FIG. 15, the coils of the torsion spring 140 can be detached from the inner wall of the housing portion 138 and can be generally closer to the shaft assembly 136 when most of the shading structure 104 is unwound from the rotary drum 120.

Figure 16:
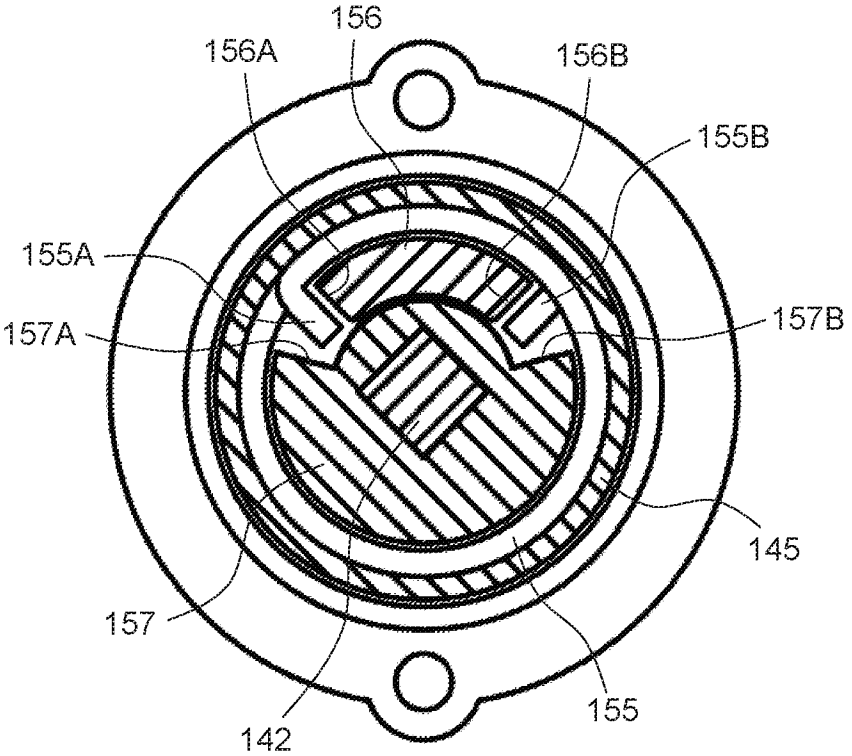
FIG. 16 is a cross-sectional view illustrating a spring adjustment mechanism provided in the actuating system.

Referring to FIGS. 12 and 13, according to an embodiment, a spring adjustment mechanism 152 may further be assembled with the head rail 102 for adjusting a biasing force applied by the torsion spring(s) 140 on the rotary drum 120. In conjunction with FIGS. 12 and 13, FIG. 16 is a cross-sectional view illustrating the spring adjustment mechanism 152. Referring to FIGS. 12, 13 and 16, the spring adjustment mechanism 152 can include an arrester 154 and an adjusting part 156. The arrester 154 can be comprised of a spring 155 having two ends 155A and 155B. The spring 155 can be disposed in a cavity of the fixed socket 145 with an outer circumference of the spring 155 in frictional contact with an inner wall of the fixed socket 145.

The shaft 142 can be fixedly connected with an abutting part 157, so that the shaft 142 and the abutting part 157 can rotate in unison. The abutting part 157 may be a distinct component part assembled with the shaft 142, or formed integrally with the shaft 142. The abutting part 157 may extend through the spring 155, and can have two flange surfaces 157A and 157B respectively adjacent to an outer side of the two ends 155A and 155B of the spring 155. The arrester 154 can be thereby operatively connected with the shaft assembly 136 via the abutting part 157. Owing to the placement of the two flange surfaces 157A and 157B relative to the two ends 155A and 155B of the spring 155, the spring 155 can prevent rotation of the shaft assembly 136 that may be induced by the biasing force applied by the torsion spring(s) 140. More specifically, the biasing force exerted by the torsion spring(s) 140 may tend to urge the shaft assembly 136 and the abutting part 157 to rotate in unison so that the flange surface 157A or 157B respectively pushes against the end 155A or 155B of the spring 155, which causes the spring 155 to enlarge and increase the friction between the spring 155 and the fixed socket 145. The frictional contact between the spring 155 and the fixed socket 145 can counteract the biasing force of the torsion spring(s) 140 and prevent rotation of the shaft assembly 136.

The adjusting part 156 can be connected pivotally with the support bracket 117B and the fixed socket 145 adjacent to the end 120B of the rotary drum 120, and can extend through an opening 158 provided on the support bracket 117B for manual operation. The adjusting part 156 can include two flange surfaces 156A and 156B that are respectively positioned adjacent to an inner side of the two ends 155A and 155B of the spring 155. Owing to the placement of the two flange surfaces 156A and 156B relative to the two ends 155A and 155B of the spring 155, a rotation of the adjusting part 156 in either direction can cause the flange surface 156A or 156B to respectively push against the end 155A or 155B of the spring 155, which causes the spring 155 to contract and loosen the frictional contact between the spring 155 and the fixed socket 145. Accordingly, the adjusting part 156 and the spring 155 can rotate in unison and urge the abutting part 157 and the shaft 142 to rotate therewith via the contact between the end 155A or 155B of the spring 155 with the flange surface 157A or 157B of the abutting part 157.

In the aforementioned construction, the arrester 154 can accordingly have a locking state and a release state. The locking state of the arrester 154 corresponds to the configuration where the spring 155 is enlarged and can prevent rotation of the shaft assembly 136 induced by the biasing force of the torsion spring(s) 140. When it is operated by a user, the adjusting part 156 can rotate and urge the arrester 154 to switch from the locking state to the release state, and then further drive the arrester 154 and the shaft assembly 136 to rotate in unison in a same direction for adjusting the biasing force applied by the torsion spring(s) 140 on the rotary drum 120.

Figure 17:
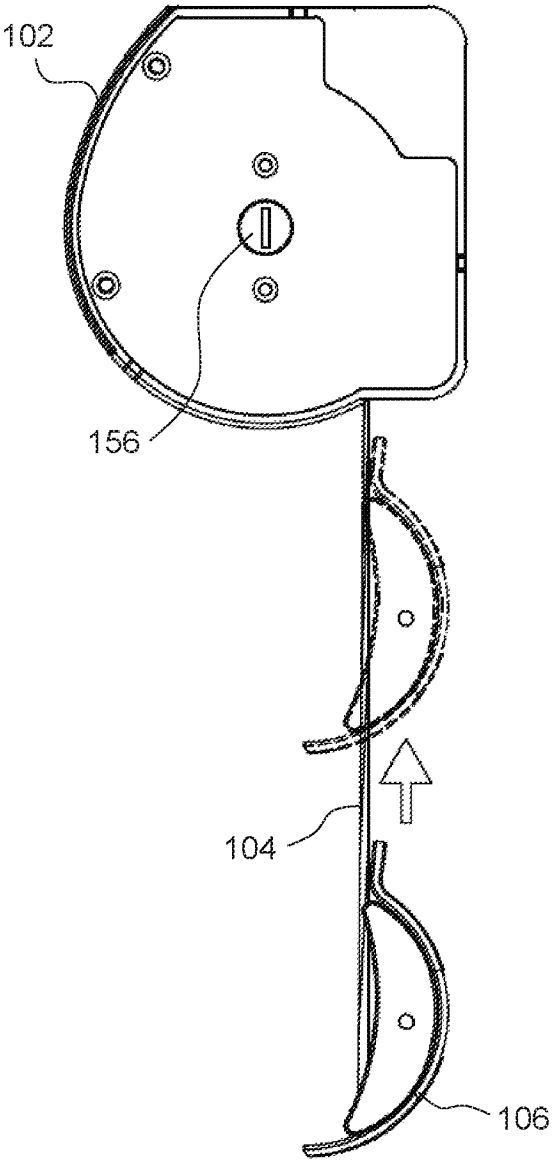
FIG. 17 is a schematic view illustrating the window shade when the torsion spring(s) in the spring unit provide an excessive biasing force.
Figure 19:
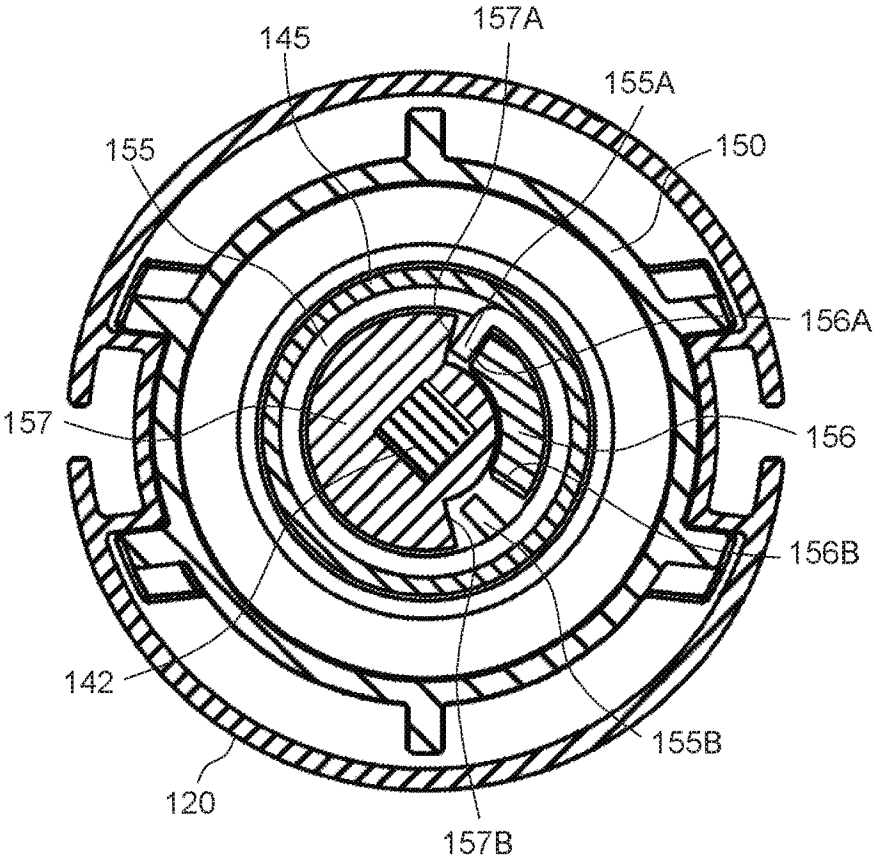
FIG. 19 is a schematic view illustrating exemplary adjustment of the spring adjustment mechanism in a first direction.
Figure 18:
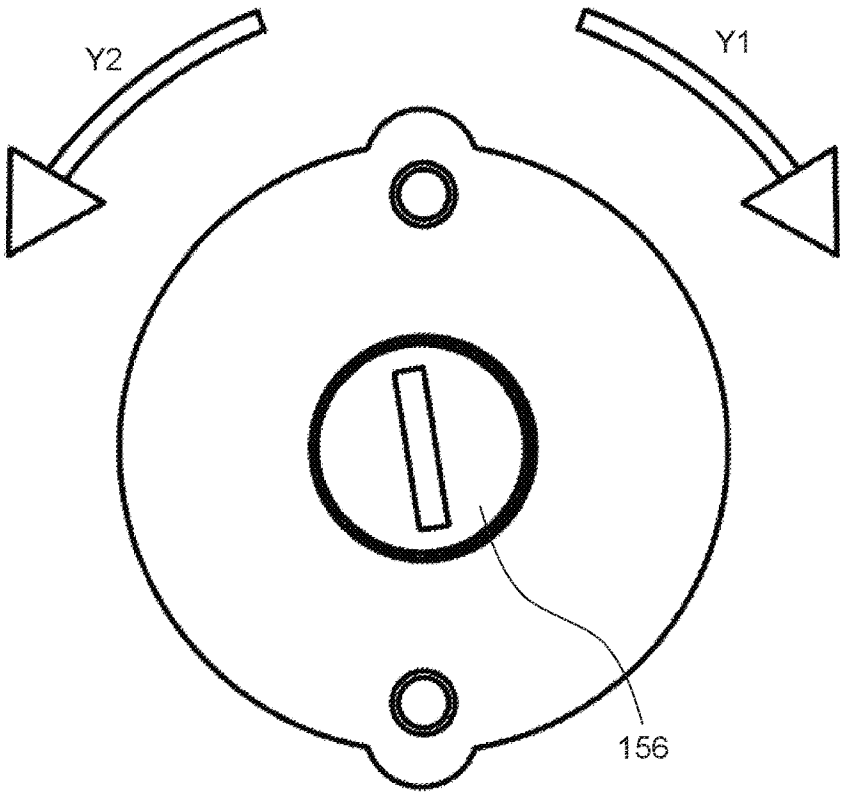
FIG. 18 is a schematic view illustrating exemplary operation of an adjusting part provided in the spring adjustment mechanism.
Figure 20:
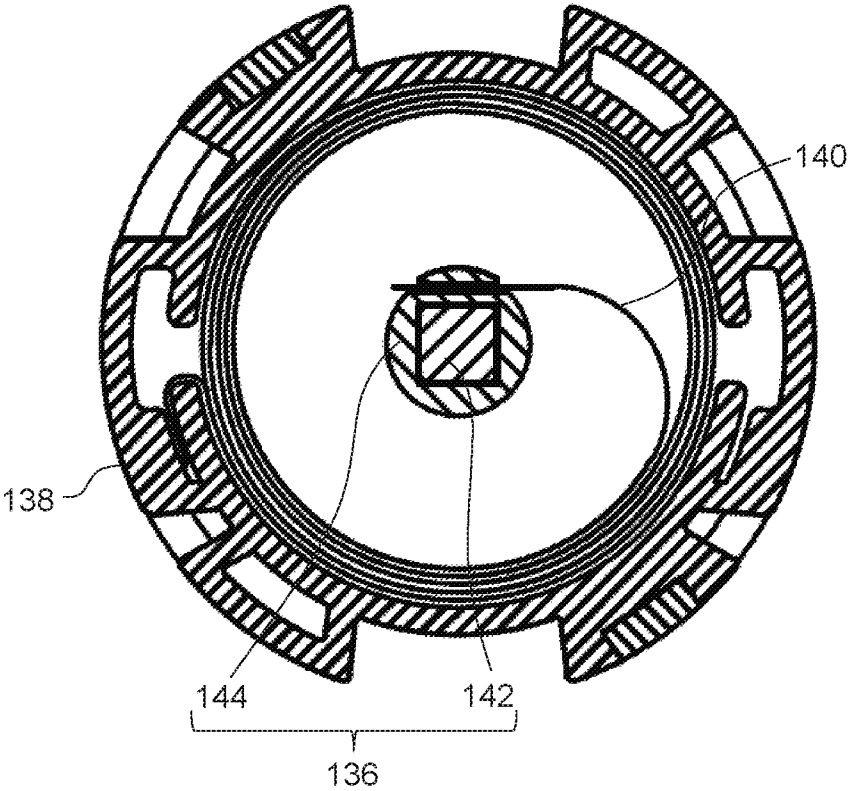
FIG. 20 is a schematic view illustrating a torsion spring of the spring unit after adjustment of the spring adjustment mechanism in the first direction.

In conjunction with FIGS. 12, 13 and 16, FIGS. 17-23 are schematic views illustrating exemplary operation of the spring adjustment mechanism 152. Referring to FIG. 17, an excessive biasing force applied by the torsion spring(s) 140 may result in the rotary drum 120 tending to rotate in the winding direction (as shown by the arrow in FIG. 17) and cause upward slipping of the shading structure 104 and the bottom part 106 after a user releases the bottom part 106 at a desired position. When this situation illustrated in FIG. 17 occurs, a user can remove the end cap 111B to expose the adjusting part 156, and then rotate the adjusting part 156 through an angle in a direction Y1 (as shown in FIG. 18). This rotational displacement of the adjusting part 156 can urge the arrester 154 to switch from the locking state to the release state and cause the shaft 142 to rotate through a same angle owing to the contact between the flange surface 156A of the adjusting part 156 and the end 155A of the spring 155 and the contact between the end 155A of the spring 155 and the flange surface 157A of the abutting part 157, as shown in FIG. 19. In this manner, the torsion spring(s) 140 can be adjusted to the configuration shown in FIG. 20 wherein the coils of the torsion spring(s) 140 can be adjacent to one another and generally closer to the inner wall of the housing portion 138. This adjustment can reduce the biasing force applied by the torsion spring(s) 140.

Figure 21:
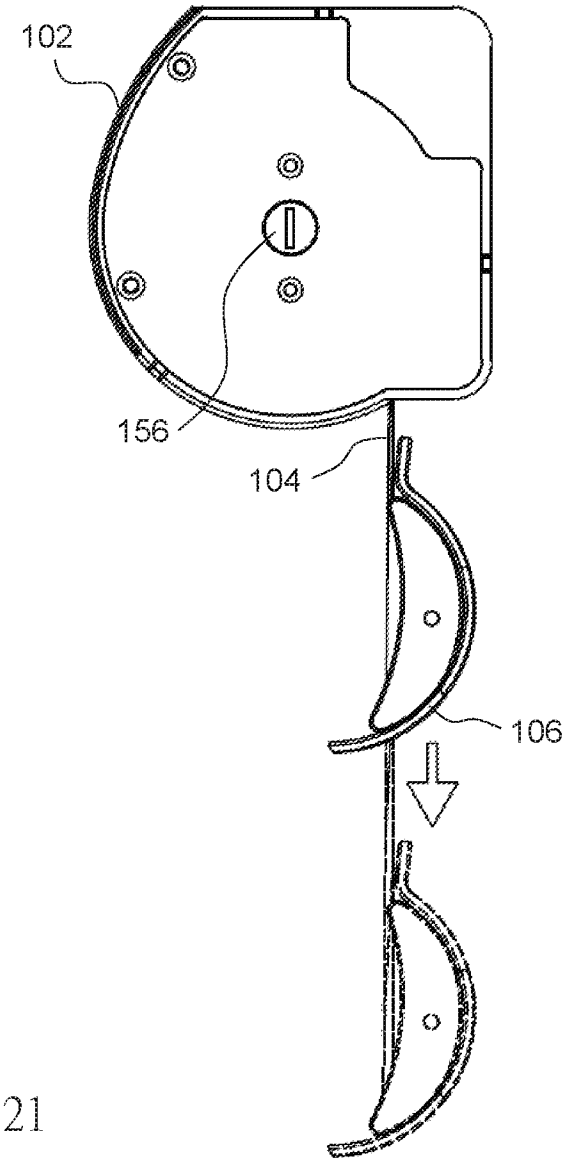
FIG. 21 is a schematic view illustrating the window shade when the torsion spring(s) in the spring unit provide an excessively weak biasing force.
Figure 23:
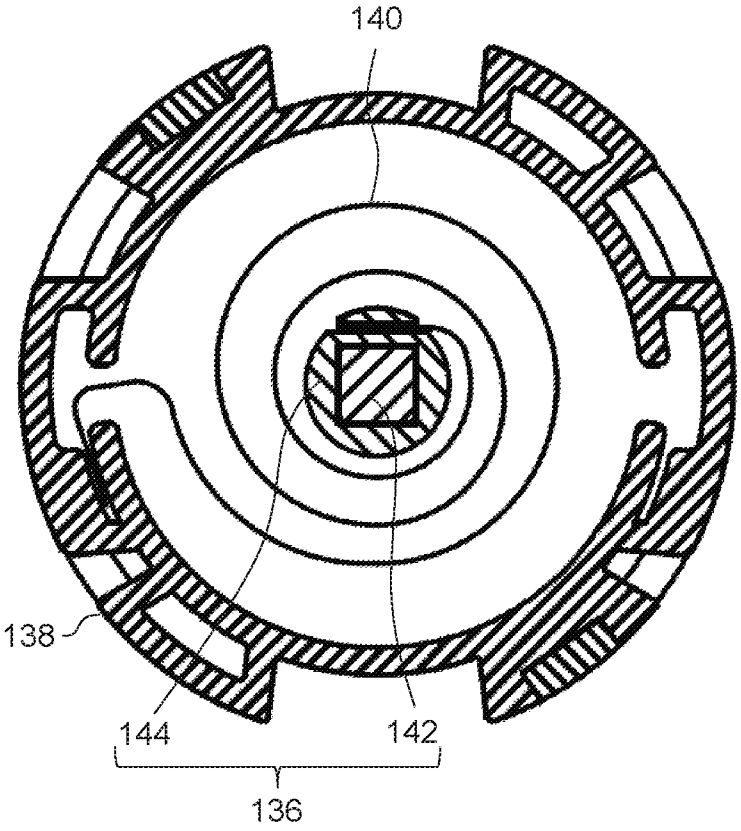
FIG. 23 is a schematic view illustrating a torsion spring of the spring unit after adjustment of the spring adjustment mechanism in the second direction.
Figure 22:
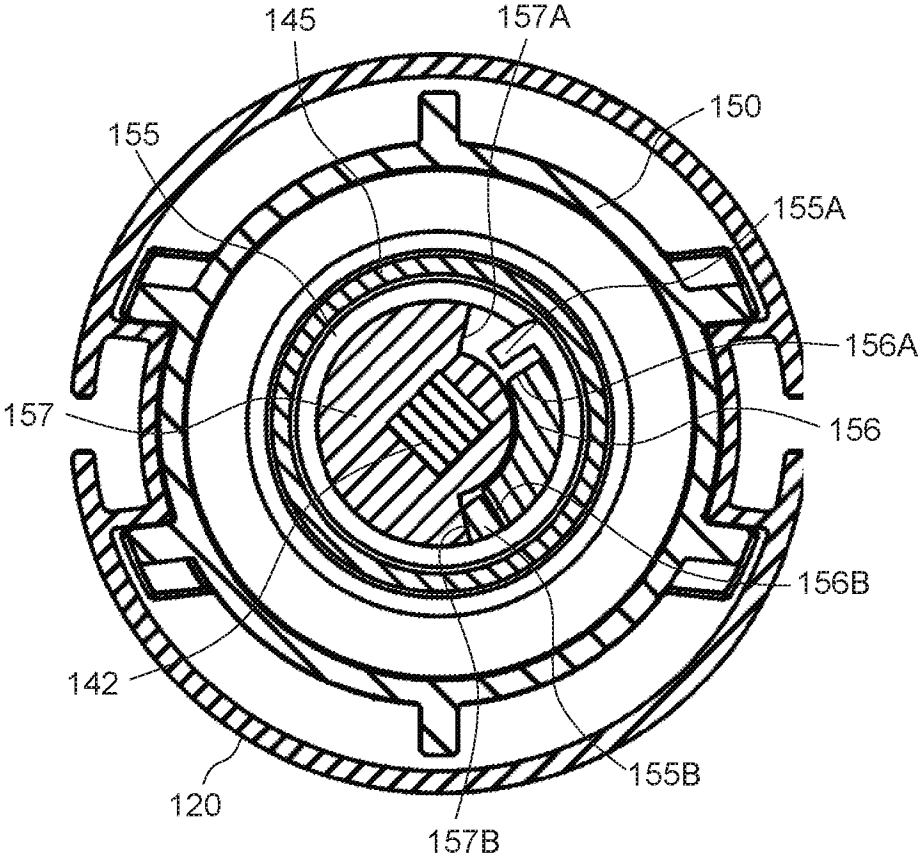
FIG. 22 is a schematic view illustrating exemplary adjustment of the spring adjustment mechanism in a second direction.
Figure 24:
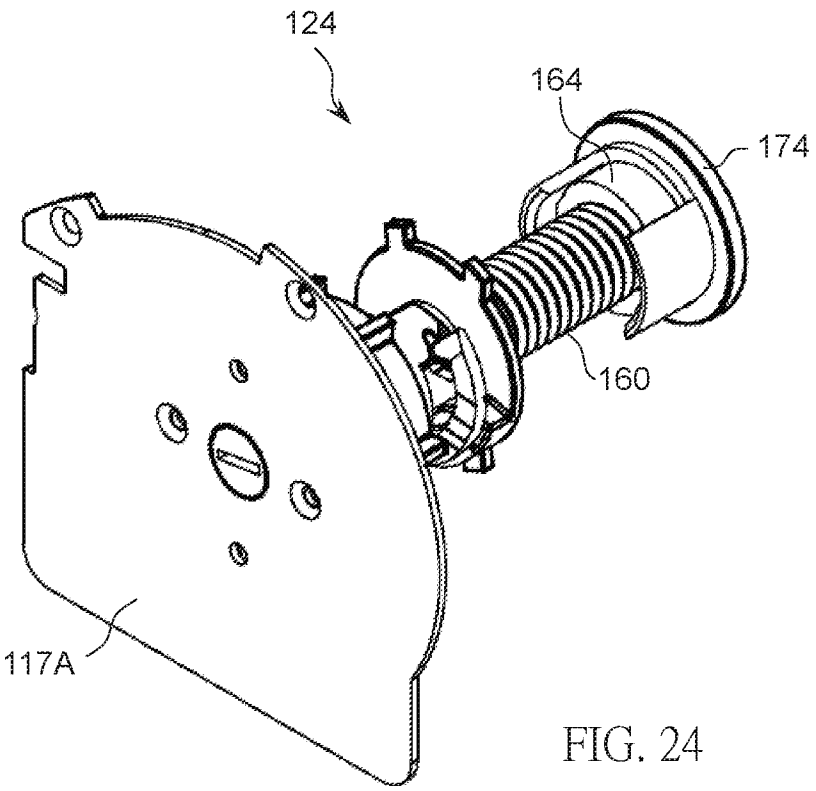
FIGS. 24 and 25 are two perspective views illustrating a limiting mechanism of the actuating system under two different angles of view.
Figure 25:
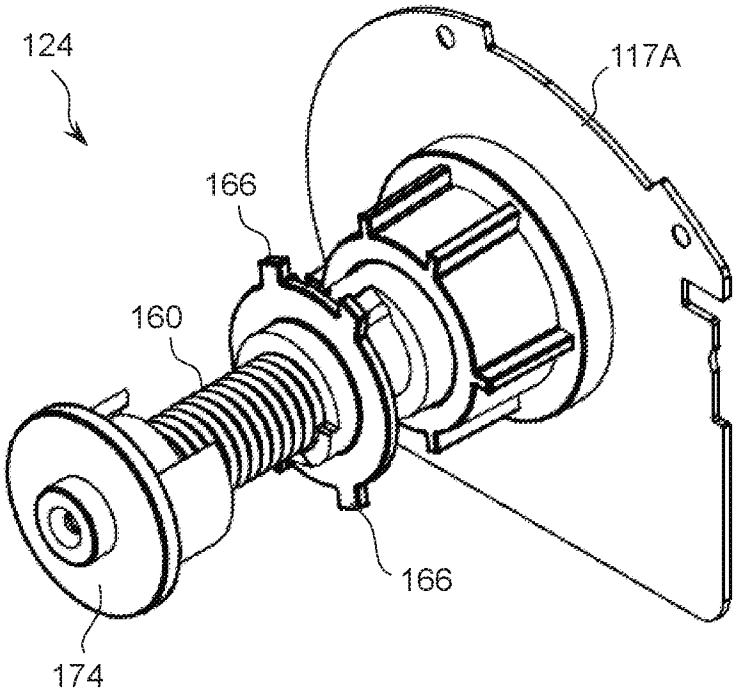

Referring to FIG. 21, an excessively weak biasing force applied by the torsion spring(s) 140 may result in the rotary drum 120 tending to rotate in the unwinding direction (as shown by the arrow in FIG. 21) and cause downward slipping of the shading structure 104 and the bottom part 106 after a user releases the bottom part 106 at a desired position. When this situation illustrated in FIG. 21 occurs, a user can rotate the adjusting part 156 through an angle in a direction Y2 (as shown in FIG. 18). This rotational displacement of the adjusting part 156 can urge the arrester 154 to switch from the locking state to the release state and cause the shaft 142 to rotate through a same angle owing to the contact between the flange surface 156B of the adjusting part 156 and the end 155B of the spring 155 and the contact between the end 155B of the spring 155 and the flange surface 157B of the abutting part 157, as shown in FIG. 22. In this manner, the torsion spring(s) 140 can be adjusted to the configuration shown in FIG. 23 wherein the coils of the torsion spring(s) 140 can be detached from the inner wall of the housing portion 138 and positioned generally closer to the shaft assembly 136. This adjustment can increase the biasing force applied by the torsion spring(s) 140.

The spring adjustment mechanism 152 as described herein thus allows a user to conveniently modify the biasing force applied by the torsion spring(s) 140 according to the weight of the shading structure 104 and the bottom part 106, so that the spring unit 122 can effectively hold the shading structure 104 and the bottom part 106 in position at any desirable height.

Although the spring adjustment mechanism 152 described herein can offer the advantageous feature of adjusting the torque output of the spring unit 122, it will be appreciated that other embodiments of the window shade may omit the spring adjustment mechanism 152. In embodiments without the spring adjustment mechanism 152, the shaft assembly 136 may be fixedly assembled, and the spring unit 122 can operate like previously described.

Referring to FIGS. 5 and 6, the limiting mechanism 124 can be connected with the support shaft 118 adjacent to the support bracket 117A, and can be further connected with the rotary drum 120. When the shading structure 104 is fully unwound from the rotary drum 120 and the bottom part 106 reaches a lowermost position, the limiting mechanism 124 can lock the shading structure 104 in the open state for light passage. In conjunction with FIGS. 5 and 6, FIGS. 24-28 are schematic views illustrating a construction of the limiting mechanism 124. Referring to FIGS. 5, 6 and 24-28, the limiting mechanism 124 can include a threaded portion 160, a stop portion 162, a limiting part 164 and a follower 166. The threaded portion 160 may be provided on the support shaft 118. According to an example of construction, the threaded portion 160 may be formed integrally with the support shaft 118. According to another example of construction, the threaded portion 160 may be a component part fixedly attached to the support shaft 118 via a fastener. The threaded portion 160 can have a diameter smaller than a diameter of the enlarged portion 118A, and can extend from the enlarged portion 118A along the pivot axis P. Accordingly, the threaded portion 160 can have two opposite ends 160A and 160B with the end 160A located adjacent to the enlarged portion 118A.

Figure 26:
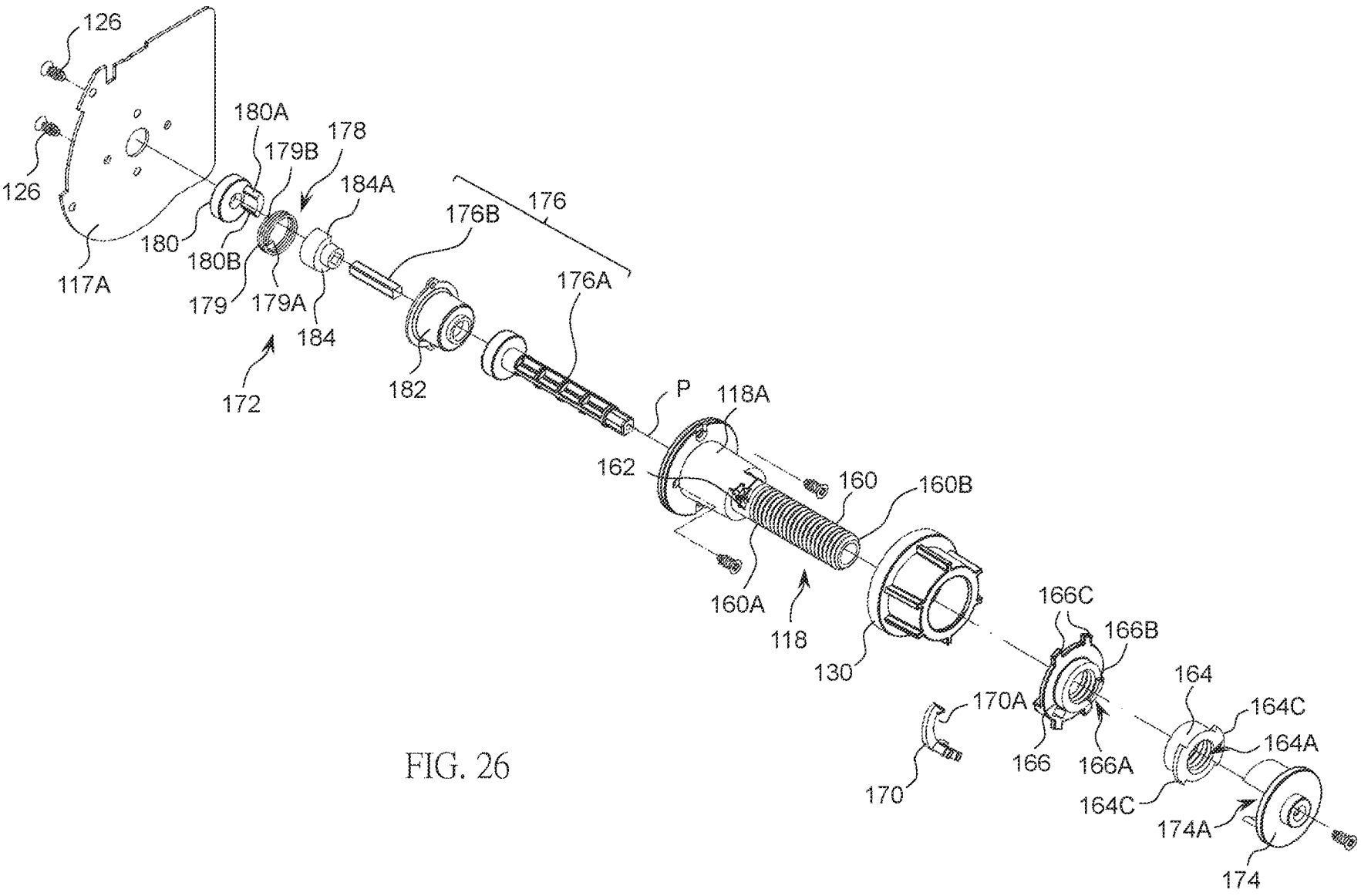
FIG. 26 is an exploded view illustrating the limiting mechanism.
Figure 28:
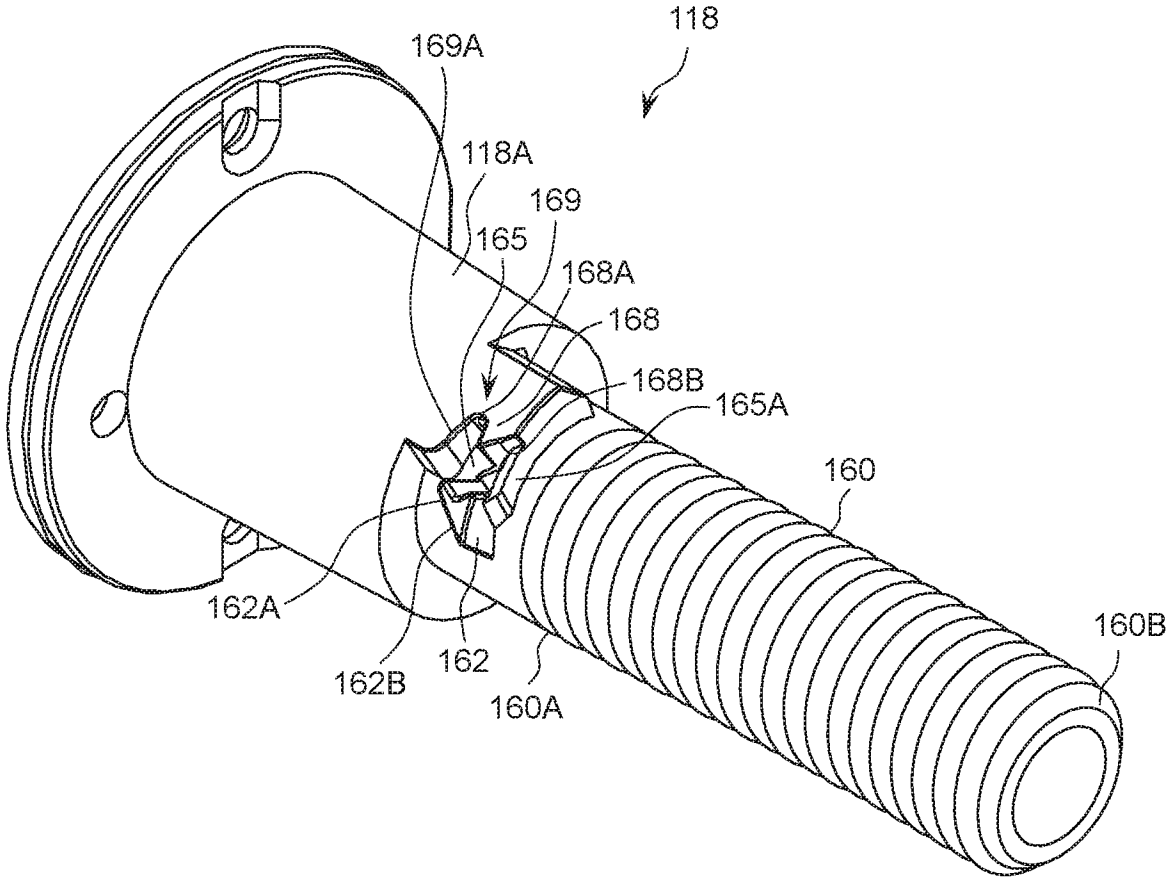
FIG. 28 is a perspective view illustrating some construction details of the limiting mechanism.

Referring to FIGS. 26 and 28, the stop portion 162 can be fixedly connected with the support shaft 118. According to an example of construction, the stop portion 162 may be formed integrally with the support shaft 118. According to another example of construction, the stop portion 162 may be a component part fixedly connected with the support shaft 118 via a fastener. The stop portion 162 can protrude radially from the support shaft 118, and can be disposed adjacent to the end 160A of the threaded portion 160. The stop portion 162 can include a recess 162A for engagement of the follower 166. The support shaft 118 can further include a sidewall surface 162B at a side of the stop portion 162. The sidewall surface 162B can be provided as a ramp and form an edge of the stop portion 162. Moreover, the support shaft 118 can include a protrusion 168 and a recess 169 facing the recess 162A of the stop portion 162. The protrusion 168 can have a sharp shape defined by two contiguous sidewall surfaces 168A and 168B, and the recess 169 can be defined between the sidewall surface 168A and another sidewall surface 169A, the protrusion 168 and the recess 169 being thereby disposed adjacent to each other. The stop portion 162 and the sidewall surfaces 168A, 168B and 169A can at least partially define a passageway 165 that is closed at one end by a barrier 165A.

Referring to FIG. 26, the limiting part 164 can be assembled with the support shaft 118. According to an example of construction, the limiting part 164 can have a cylindrical shape including a threaded hole 164A, and can include a flange 164B protruding axially at a periphery of the limiting part 164 (as better shown in FIG. 30). The limiting part 164 can be assembled with the support shaft 118 with the threaded portion 160 engaged with the threaded hole 164A of the limiting part 164, the limiting part 164 being positioned adjacent to the end 160B of the threaded portion 160.

The follower 166 can be connected with the support shaft 118, and can move along the support shaft 118. According to an example of construction, the follower 166 can have a cylindrical shape having a threaded hole 166A, and can include a flange 166B protruding axially at a side of the follower 166. Moreover, an outer circumference of the follower 166 can have a plurality of ribs 166C that are distributed around the threaded hole 166A and protrude along different radial directions. According to an example of construction, the follower 166 including the flange 166B and the ribs 166C may be formed integrally as a single part. In addition, the follower 166 may further have a resilient arm 170 disposed at a side opposite to that of the flange 166B. The resilient arm 170 can be connected with the follower 166 at a location radially away from the threaded hole 166A, and can elastically deflect to the left or right side parallel to the axis of the threaded hole 166A.

When the follower 166 is assembled with the support shaft 118, the threaded portion 160 of the support shaft 118 can be engaged with the threaded hole 166A of the follower 166, the flange 166B of the follower 166 can face the limiting part 164, and the resilient arm 170 of the follower 166 can face the end 160A of the threaded portion 160. The follower 166 can rotate around the threaded portion 160 and concurrently slide along the threaded portion 160 toward the stop portion 162 or the limiting part 164, and the resilient arm 170 can move in unison with the follower 166 during rotation and sliding movement of the follower 166 on the threaded portion 160.

When the limiting mechanism 124 is assembled with the rotary drum 120, the support shaft 118 (including the threaded portion 160 and the stop portion 162 thereof), the limiting part 164 and the follower 166 can all be received inside the rotary drum 120. Moreover, the ribs 166C of the follower 166 can be connected with an inner side of the rotary drum 120 so that the follower 166 is rotationally coupled to the rotary drum 120 but can slide axially relative to the rotary drum 120. Accordingly, a rotation of the rotary drum 120 can drive the follower 166 to rotate in a synchronously manner and slide along the threaded portion 160 of the support shaft 118. Since the threaded portion 160 extends along the pivot axis P of the rotary drum 120, the follower 166 can slide along the pivot axis P of the rotary drum 120.

Figure 30:
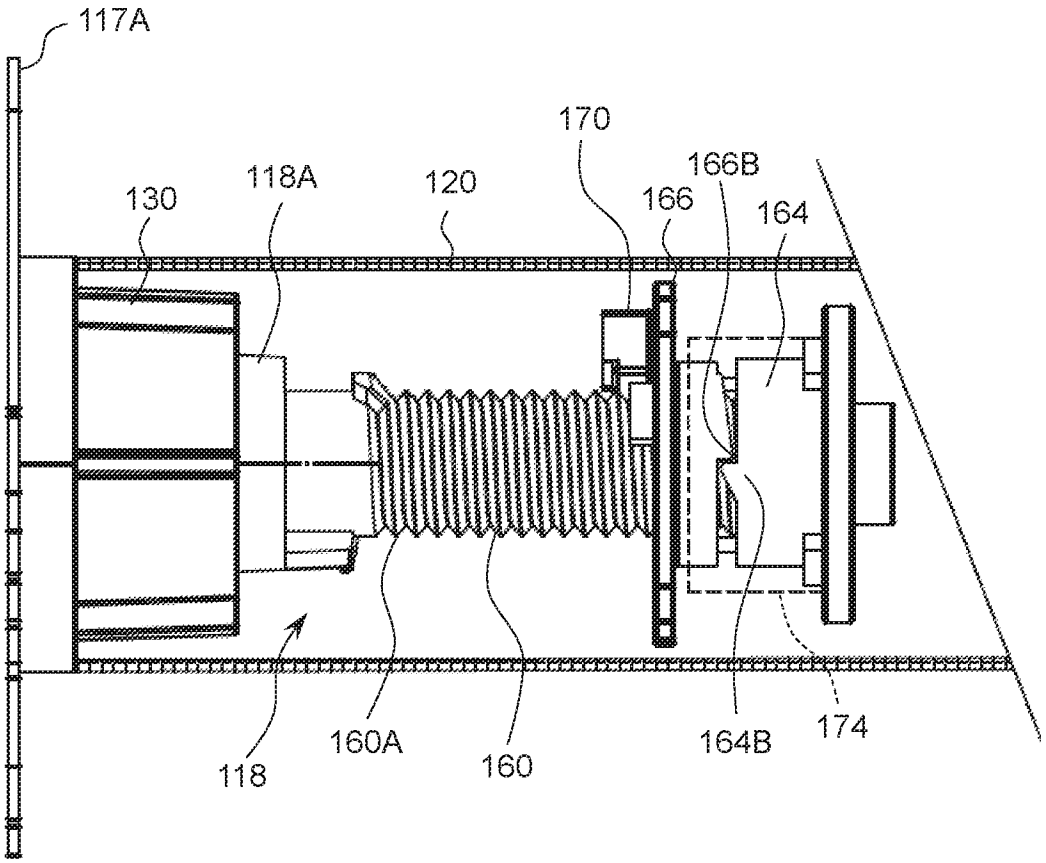
FIG. 30 is a schematic view illustrating a configuration of the limiting mechanism when most of the shading structure is wound around the rotary drum as shown in FIG. 29.
Figure 38:
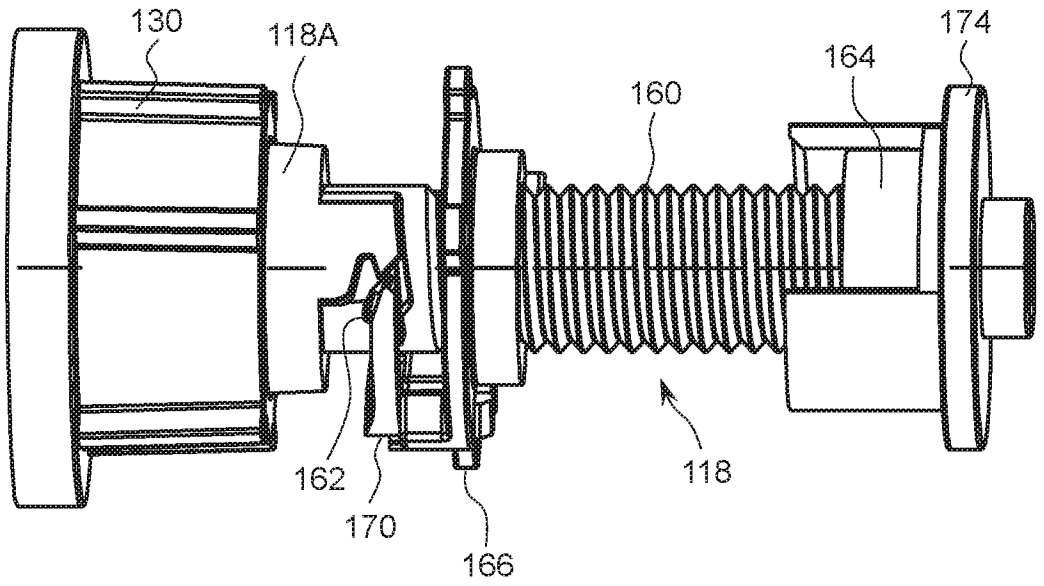
FIG. 38 is a perspective view illustrating the limiting mechanism in the locking state.
Figure 37:
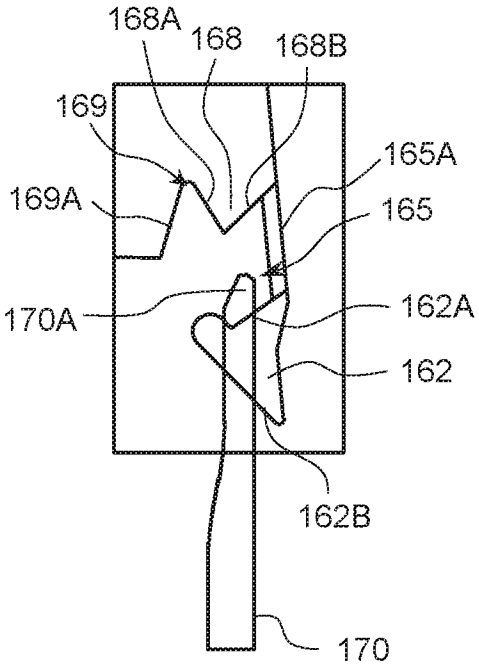
FIG. 37 is a schematic view illustrating a portion of the limiting mechanism in the locking state.
Figure 40:
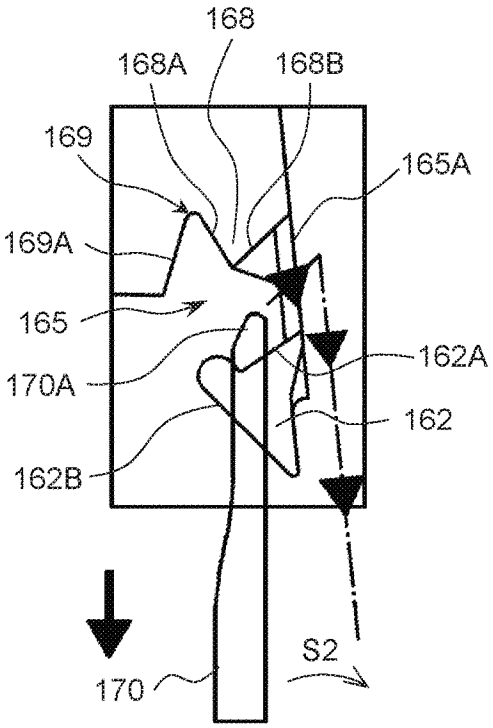
FIGS. 40 and 41 are two schematic views illustrating a portion of the limiting mechanism when it is switched to the unlocking state.
Figure 39:
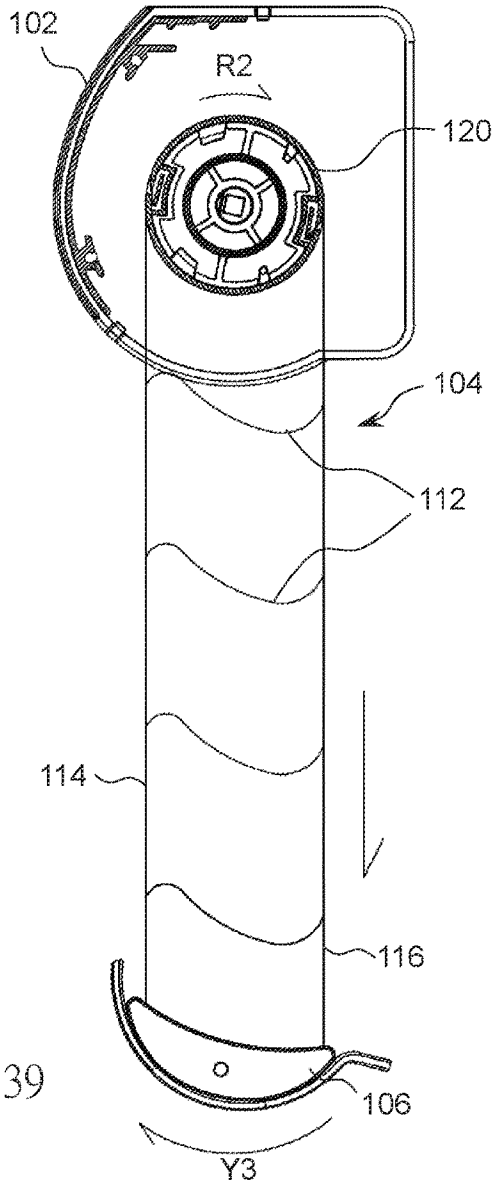
FIG. 39 is a schematic view illustrating exemplary operation of the bottom part for switching the limiting mechanism to an unlocking state.

In the limiting mechanism 124 described herein, the follower 166 is movable along the threaded portion 160 of the support shaft 118 between a first position shown in FIG. 30 and a second position shown in FIG. 38, the follower 166 being adjacent to the limiting part 164 in the first position and adjacent to the stop portion 162 at the end 160A of the threaded portion 160 in the second position. The course of the follower 166 between the aforementioned two positions can generally correspond to a range of vertical adjustment of the bottom part 106 during use. A rotation of the rotary drum 120 in the winding direction can drive the follower 166 to move toward the limiting part 164, and a rotation of the rotary drum 120 in the unwinding direction can drive the follower 166 to move toward the stop portion 162.

When the follower 166 is in the second position, the follower 166 can interlock with the stop portion 162 by engagement of the resilient arm 170 with the stop portion 162. This locking engagement corresponds to a locking state of the limiting mechanism 124, and can prevent further rotation of the rotary drum 120 in the winding direction.

When the resilient arm 170 of the follower 166 is disengaged from the stop portion 162, the limiting mechanism 124 is in an unlocking state, and rotation of the rotary drum 120 in both the winding and unwinding directions is allowed.

Figure 29:
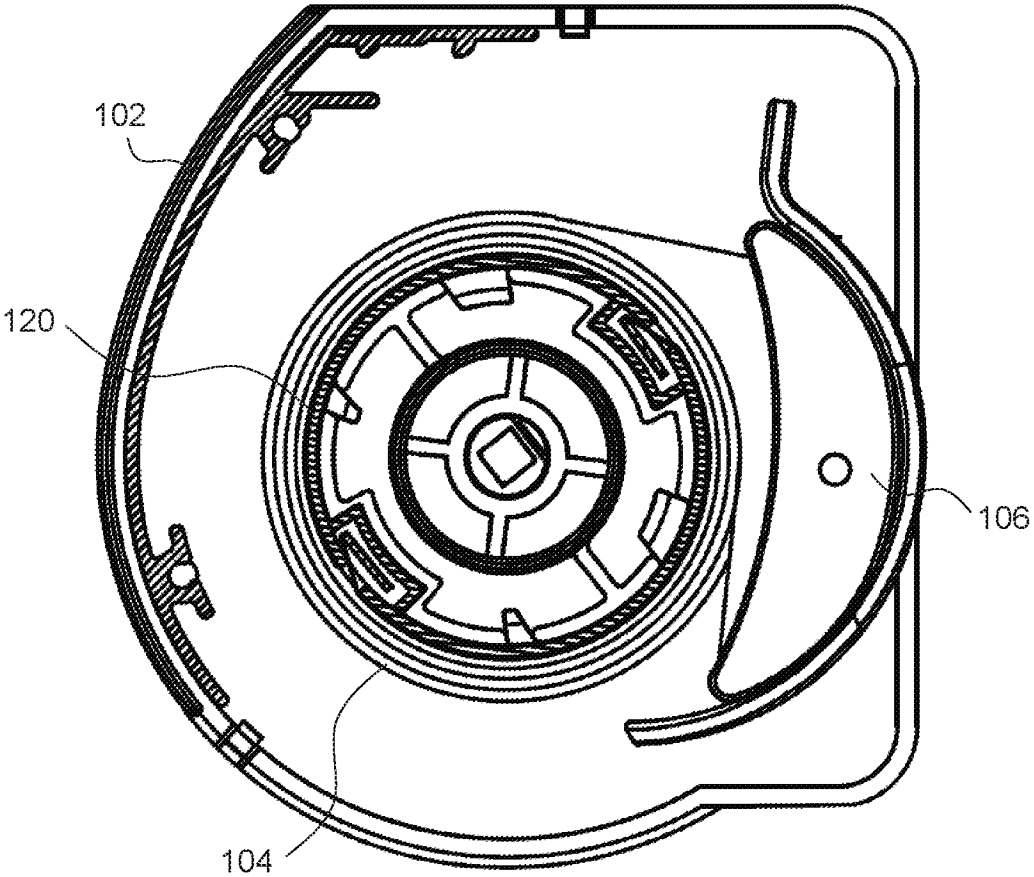
FIG. 29 is a schematic view illustrating the window shade when most of the shading structure is wound around the rotary drum.

In conjunction with FIGS. 24-28, reference is made hereinafter to FIGS. 29-42 for describing exemplary operation of the limiting mechanism 124. Referring to FIGS. 29 and 30, when the follower 166 is in the first position, the flange 166B of the follower 166 can contact with the flange 164B of the limiting part 164, and most of the shading structure 104 is wound around the rotary drum 120 so that the bottom part 106 is positioned adjacent to the head rail 102. The contact between the follower 166 and the limiting part 164 can stop the follower 166 in the first position and block further displacement of the follower 166 toward the limiting part 164. This can correspond to a highest position of the bottom part 106. The limiting part 164 only provides a unidirectional stop, and does not prevent the follower 166 from moving in the opposite direction toward the stop portion 162. Accordingly, a rotation of the rotary drum 120 in the other direction can drive the follower 166 to move away from the limiting part 164 and toward the stop portion 162.

Figure 32:
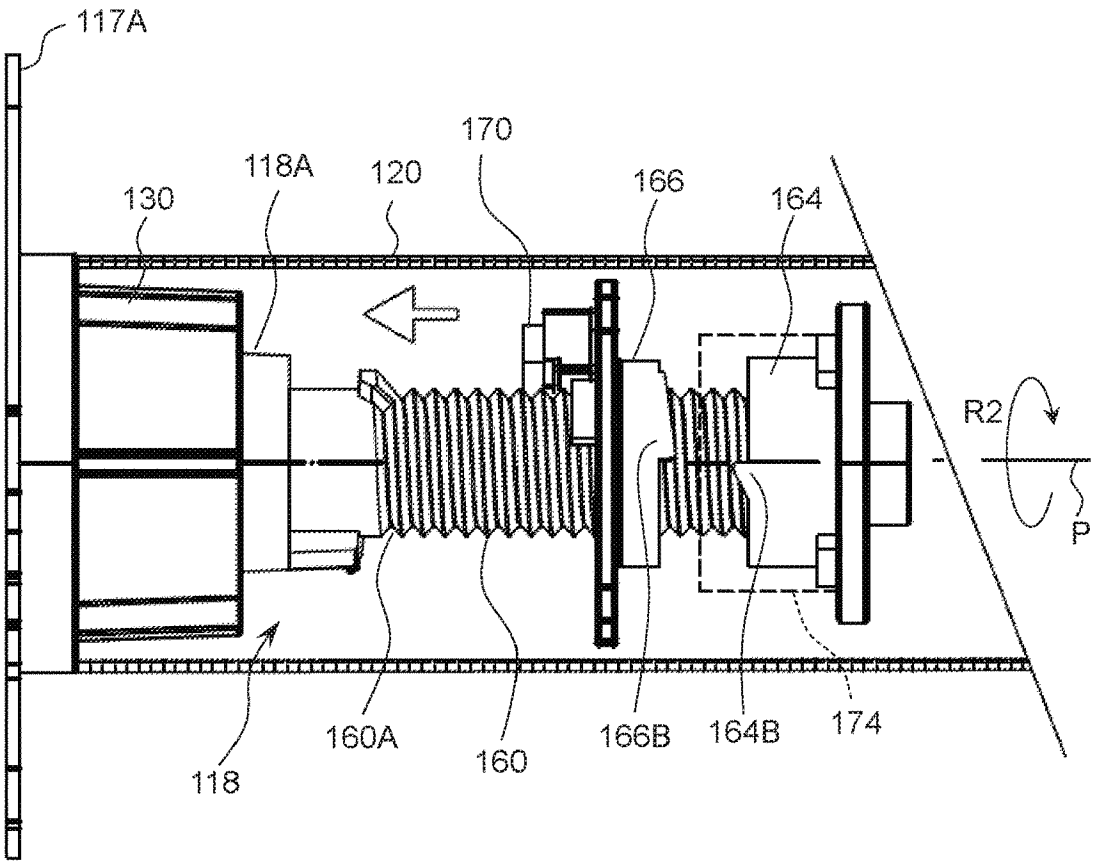
FIG. 32 is a schematic view illustrating an intermediate configuration of the limiting mechanism during downward adjustment of the shading structure as shown in FIG. 31.
Figure 31:
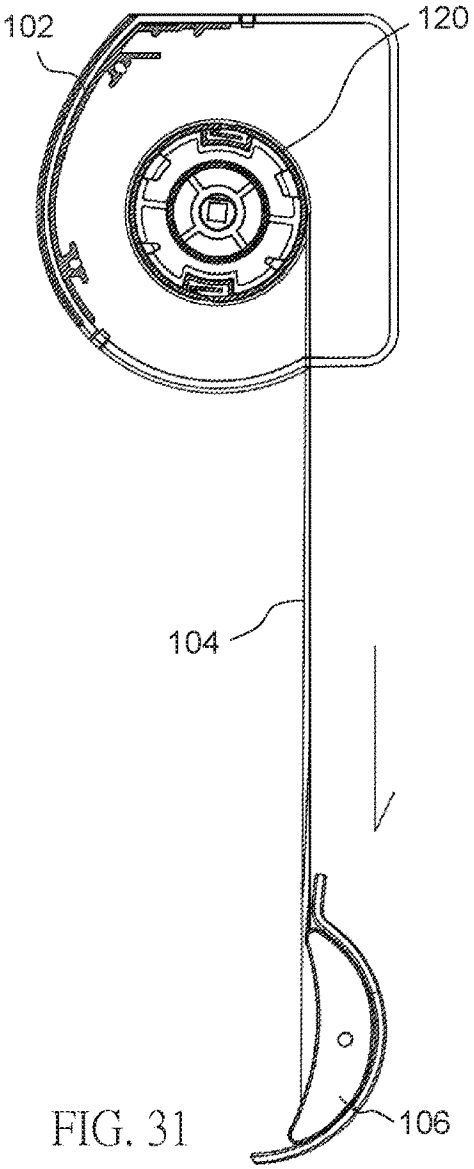
FIG. 31 is a schematic view illustrating a downward adjustment of the shading structure in the window shade.

Referring to FIGS. 31 and 32, when a user pulls the bottom part 106 downward, the rotary drum 120 can rotate in the direction R2 and the shading structure 104 can unwind and extend downward from the rotary drum 120. This rotation of the rotary drum 120 in the direction R2 can drive the follower 166 to slide along the pivot axis P away from the limiting part 164. During vertical movement of the bottom part 106, the limiting mechanism 124 can maintain the unlocking state (which allows rotation of the rotary drum 120 in any of the winding and unwinding directions), and the shading structure 104 keeps the closed state with the two suspending parts 114 and 116 adjacent to each other and the transversal vanes 112 oriented generally vertically.

Figure 34:
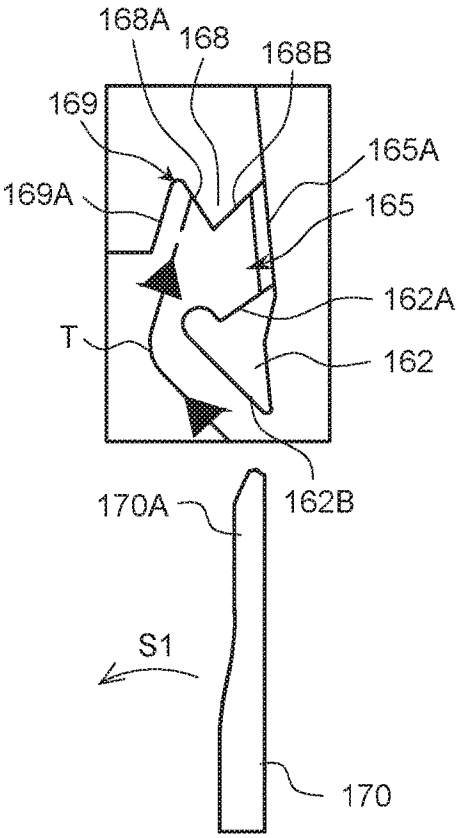
FIGS. 34 and 35 are two schematic views illustrating a portion of the limiting mechanism when it is switched to the locking state.
Figure 33:
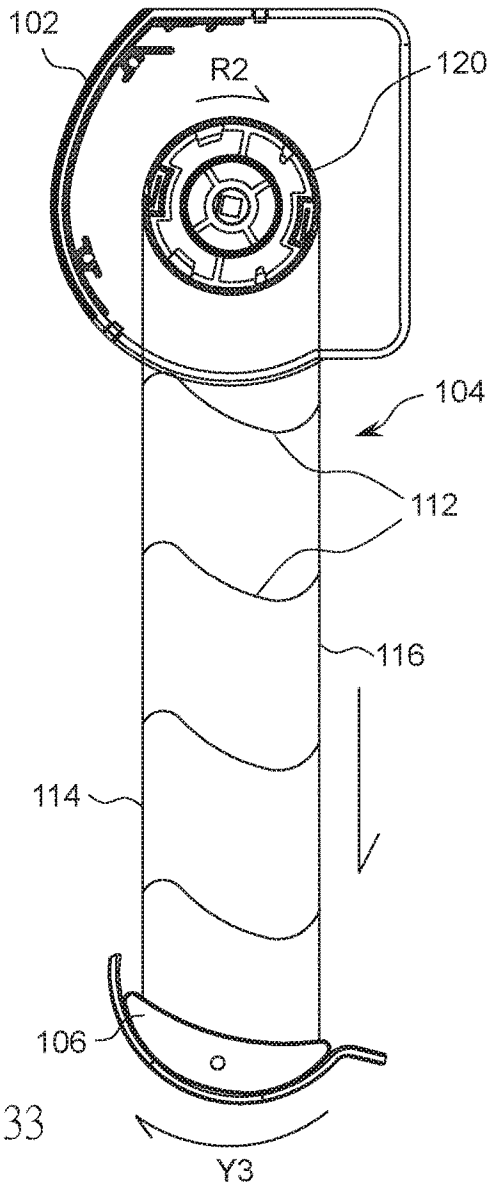
FIG. 33 is a schematic view illustrating exemplary operation of a bottom part of the window shade for switching the limiting mechanism to a locking state after the bottom part has a reached a lowermost position.
Figure 36:
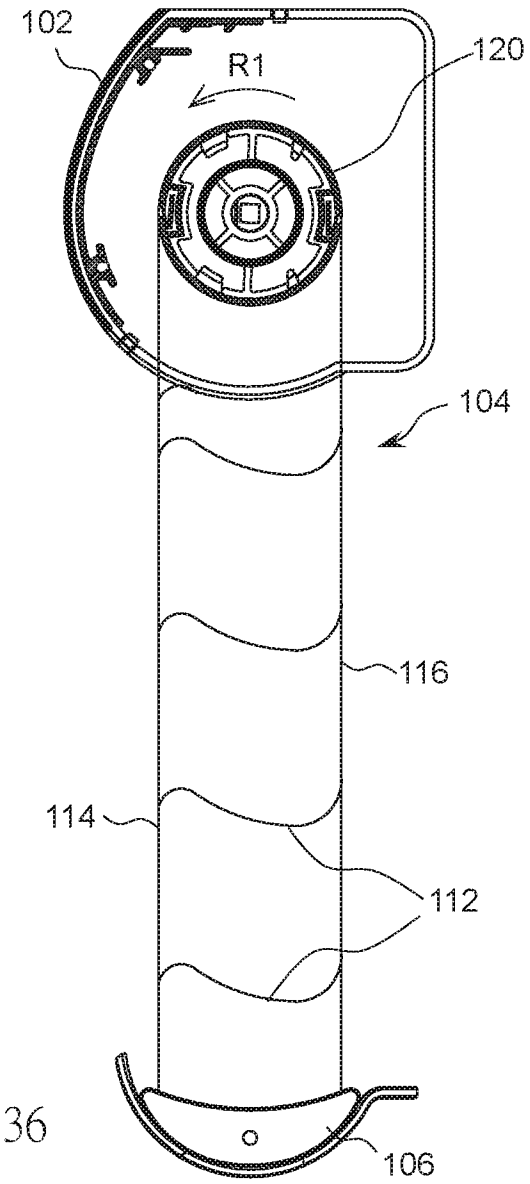
FIG. 36 is a schematic view illustrating the window shade with the bottom part locked in the lowermost position.
Figure 35:
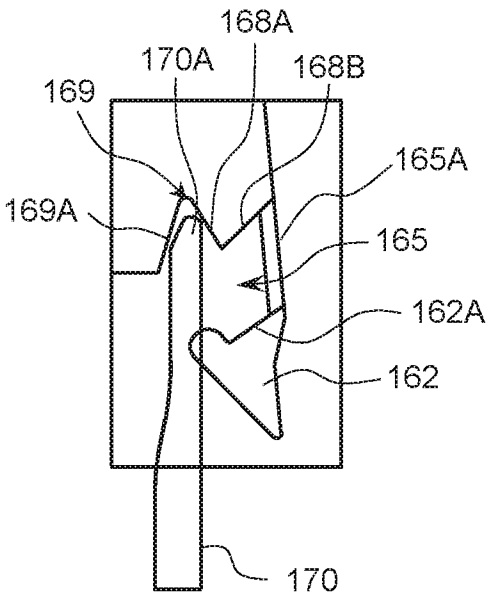

Referring to FIGS. 33 and 34, when the bottom part 106 reaches a lowermost position, the shading structure 104 is fully extended from the rotary drum 120 and is in the open state, and the resilient arm 170 of the follower 166 is adjacent to the stop portion 162. While the bottom part 106 is in the lowermost position, a user can slightly rotate the bottom part 106 in a direction Y3, which causes the rotary drum 120, the follower 166 and the resilient arm 170 to rotate in unison in the direction R2, whereby the sidewall surface 162B can push the resilient arm 170 to deflect to a first side S1. As a result, a tip 170A of the resilient arm 170 then can be guided to move along a path T until the tip 170A abuts against the sidewall 168A in the recess 169, as shown in FIG. 35.

Referring to FIGS. 35-38, after the tip 170A of the resilient arm 170 reaches the recess 169, the user can release the bottom part 106. As a result, the spring unit 122 can urge the rotary drum 120, the follower 166 and the resilient arm 170 to rotate in unison through an angle in the direction R1, which causes the tip 170A of the resilient arm 170 to engage with the stop portion 162. The follower 166 can be thereby engaged with the stop portion 162 in the second position, and the shading structure 104 can be kept in the open state fully extended from the rotary drum 120. The engagement of the follower 166 with the stop portion 162 can prevent the follower 166 from moving from the second position toward the first position.

With the construction described herein, while the shading structure 104 is fully extended from the rotary drum 120, a user simply needs to slightly rotate the bottom part 106 to impart a limited rotation of the rotary drum 120 in the direction R2, which can switch the limiting mechanism 124 from the unlocking state to the locking state. The locking state of the limiting mechanism 124 can prevent the rotary drum 120 from rotating in the direction R1, which can prevent the bottom part 106 and the shading structure 104 from rising upward. As a result, the bottom part 106 can be locked at the lowermost position, and the shading structure 104 can be maintained in the open state for light passage with the transversal vanes 112 oriented generally horizontally.

Figure 42:
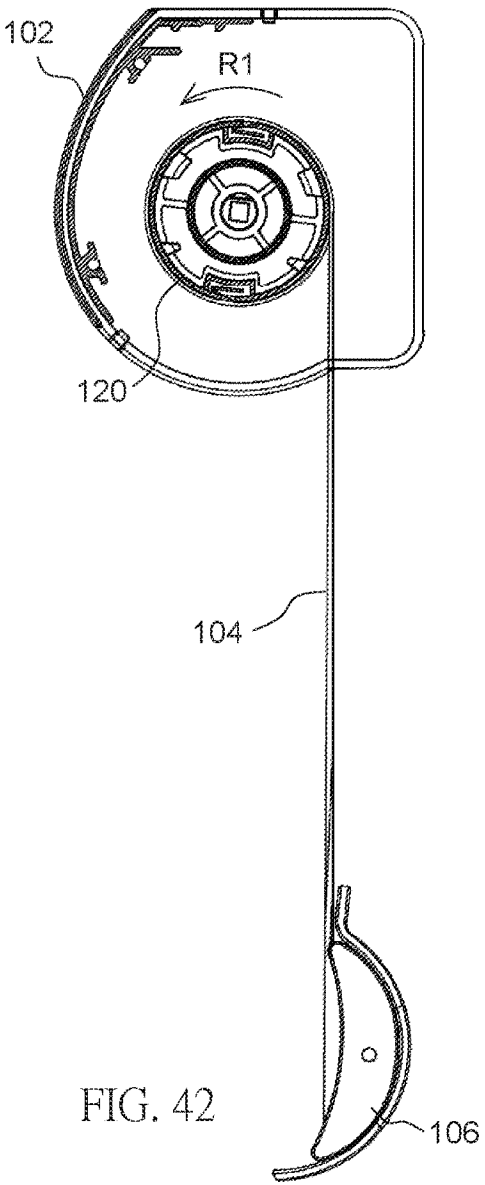
FIG. 42 is a schematic view illustrating the window shade with the bottom part unlocked in the lowermost position.
Figure 41:
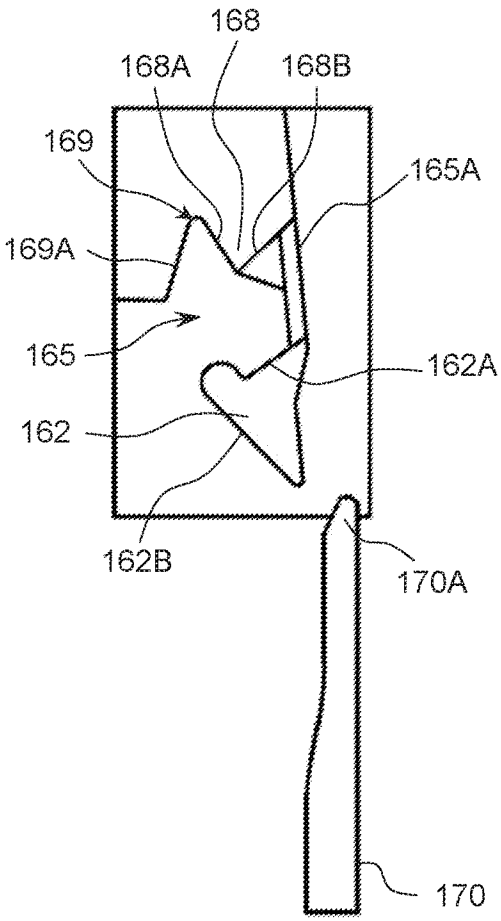

Referring to FIGS. 39-42, for switching the limiting mechanism 124 from the locking state to the unlocking state, a user can slightly rotate the bottom part 106 in the direction Y3, which causes the rotary drum 120, the follower 166 and the resilient arm 170 to rotate in unison in the direction R2, whereby the sidewall surface 168B can push the resilient arm 170 to deflect to a second side S2 opposite to the first side 51. As a result, the tip 170A of the resilient arm 170 can move away from the recess 162A of the stop portion 162 and travel over the barrier 165A. Subsequently, the user can release the bottom part 106, and the spring unit 122 can urge the rotary drum 120, the follower 166 and the resilient arm 170 to rotate in unison through an angle in the direction R1 (as shown in FIG. 42), which causes the tip 170A of the resilient arm 170 to completely disengage from the stop portion 162. The limiting mechanism 124 can be thereby switched to the unlocking state.

With the construction described herein, when the limiting mechanism 124 is in the locking state, a user simply needs to slightly rotate the bottom part 106 to impart a limited rotation of the rotary drum 120 in the direction R2, which can switch the limiting mechanism 124 from the locking state to the unlocking state.

After the limiting mechanism 124 is unlocked, the user can raise the bottom part 106 toward the head rail 102. As a result, the spring unit 122 can urge the rotary drum 120, the follower 166 and the resilient arm 170 to rotate in unison in the direction R1, whereby the shading structure 104 can be wound around the rotary drum 120. While the follower 166 and the resilient arm 170 rotate, they also slide along the pivot axis P away from the stop portion 162 and toward the limiting part 164.

When the flange 166B of the follower 166 contacts against the flange 164B of the limiting part 164, the limiting part 164 can stop the follower 166 in the first position shown in FIG. 30, which can prevent the rotary drum 120 from further rotating in the direction R1. The bottom part 106 can be thereby held in a highest position and most of the shading structure 104 can be wound around the rotary drum 120.

Because the length of the shading structure 104 may vary depending on the size of the window shade 100, there may be a need for adjusting the highest position of the bottom part 106 as desired. According to an embodiment, the limiting mechanism 124 can further include a limit setting assembly 172 operable to modify and set a position of the limiting part 164 on the threaded portion 160 for properly configuring a highest position of the bottom part 106.

In conjunction with FIGS. 6 and 24-27, FIG. 43 is a cross-sectional view illustrating the limit setting assembly 172. Referring to FIGS. 6, 24-27 and 43, the limit setting assembly 172 can include a collar 174, a transmission axle 176, an arrester 178 and an adjusting part 180. The collar 174 can be disposed adjacent to the end 160B of the threaded portion 160, and can have a cavity 174A for assembly of the limiting part 164. The limiting part 164 can have an outer circumference provided with a plurality of ribs 164C (better shown in FIG. 26) that project outward along different radial directions, the ribs 164C being fixedly connected with the limiting part 164. When the limiting part 164 is assembled in the cavity 174A of the collar 174, the ribs 164C can be connected with an inner wall of the collar 174 so that the limiting part 164 is rotationally coupled to the collar 174 but can slide axially along the threaded portion 160 relative to the collar 174.

Figure 27:
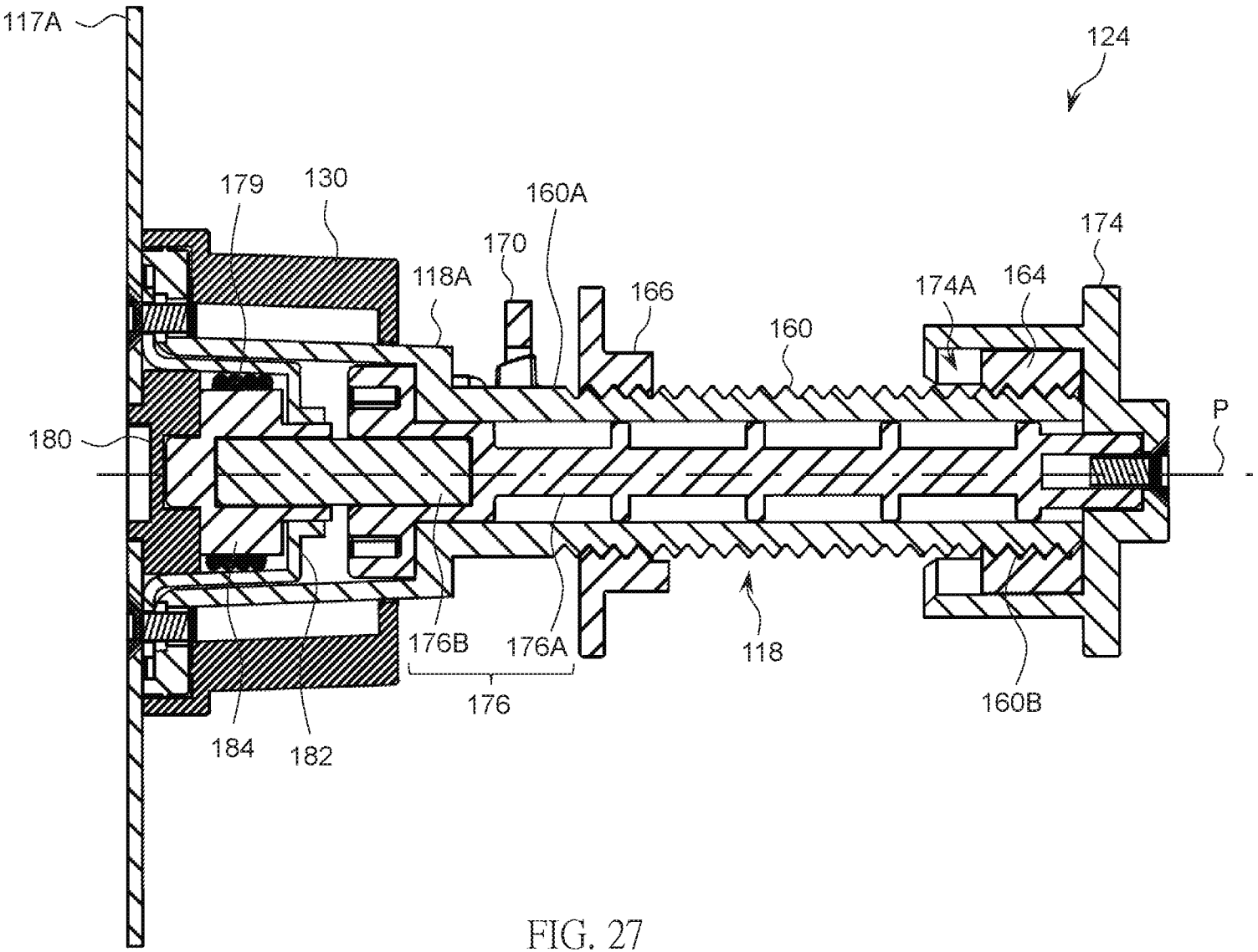
FIG. 27 is a cross-sectional view illustrating the limiting mechanism.

Referring to FIGS. 26 and 27, the transmission axle 176 may include two sections 176A and 176B that are connected with each other so as to form an assembly rotatable as a single block. It will be appreciated, however, that the transmission axle 176 is not limited to this construction. In some variant construction, the transmission axle 176 may be formed integrally as a single part. The transmission axle 176 can extend along the pivot axis P through a hollow interior of the support shaft 118, and can have an end (e.g., on the section 176A) fixedly connected with the collar 174. The transmission axle 176 and the collar 174 can thereby rotate in unison relative to the support shaft 118 for driving the limiting part 164 to slide on the threaded portion 160, thereby adjusting the position of the limiting part 164 on the threaded portion 160.

Figure 43:
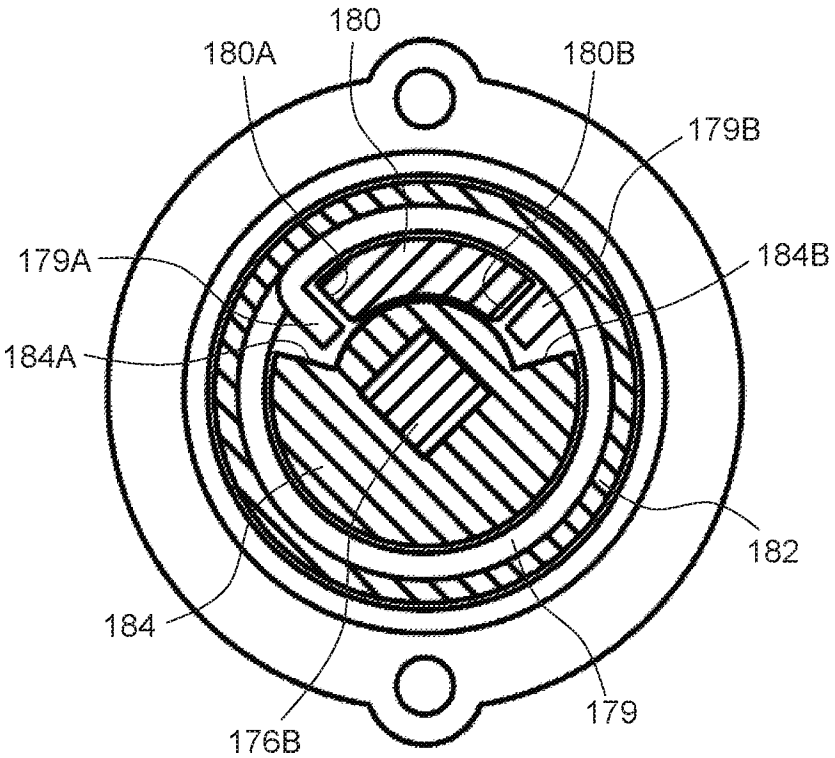
FIG. 43 is a cross-sectional view illustrating a limit setting assembly provided in the limiting mechanism.

Referring to FIGS. 26, 27 and 43, the head rail 102 can further be fixedly connected with a fixed socket 182. The fixed socket 182 may be disposed inside the enlarged portion 118A of the support shaft 118, and can be fixedly attached to the support bracket 117A of the head rail 102 via a fastener 126. The fixed socket 182 can be thereby fixedly connected with the support shaft 118 and remain stationary. The arrester 178 can include a spring 179 having two opposite ends 179A and 179B that is disposed inside a cavity of the fixed socket 182. The spring 179 can be assembled with an outer circumference of the spring 179 in frictional contact with an inner wall of the fixed socket 182. Both the arrester 178 and the fixed socket 182 can be thereby assembled inside the enlarged portion 118A.

The other end of the transmission axle 176 (e.g., on the section 176B) opposite to the collar 174 can be fixedly connected with an abutting part 184, so that the transmission axle 176 and the abutting part 184 are rotatable in unison. According to an example of construction, the abutting part 184 may be a distinct component part that is assembled with the transmission axle 176. According to another example of construction, the abutting part 184 may be formed integrally with the transmission axle 176. The abutting part 184 can extend through the spring 179, and can have two flange surfaces 184A and 184B respectively disposed adjacent to an outer side of the two ends 179A and 179B of the spring 179 (as better shown in FIG. 43). Accordingly, the arrester 178 can be operatively connected with the transmission axle 176 via the abutting part 184.

The arrester 178 can have a locking state and a release state. The locking state of the arrester 178 can prevent a rotational displacement of the transmission axle 176, the collar 174 and the limiting part 164 that may be induced by a contact between the follower 166 and the limiting part 164. More specifically, when the follower 166 moving along the threaded portion 160 contacts against the limiting part 164 (which corresponds to a highest position of the bottom part 106 as described previously), a resulting force applied on the limiting part 164 can be transferred through the collar 174 and the transmission axle 176 to the abutting part 184, which causes the flange surface 184A or 184B of the abutting part 184 to push against the corresponding end 179A or 179B of the spring 179, thereby urging the spring 179 to enlarge. The friction between the enlarged spring 179 and the fixed socket 182 can be thereby increased, which can provide a counter-action force preventing rotation of the transmission axle 176, the collar 174 and the limiting part 164.

Referring to FIGS. 5, 26, 27 and 43, the adjusting part 180 can be pivotally connected with the support bracket 117A and the fixed socket 182 adjacent to the end 120A of the rotary drum 120, and can extend through an opening provided on the support bracket 117A for manual operation. The adjusting part 180 can extend through the spring 179 of the arrester 178, and can have two flange surfaces 180A and 180B respectively disposed adjacent to an inner side of the two ends 179A and 179B of the spring 179. Owing to the placement of the two flange surfaces 180A and 180B relative to the two ends 179A and 179B of the spring 179, a rotation of the adjusting part 180 can urge the arrester 178 to switch from the locking state to the release state for adjusting the position of the limiting part 164 on the threaded portion 160. In particular, a rotation of the adjusting part 180 can cause the flange surface 180A or 180B to push against the corresponding end 179A or 179B of the spring 179, which causes the spring 179 to contract and loosen the frictional contact between the spring 179 and the fixed socket 182. Accordingly, the adjusting part 180 and the loosened spring 179 can rotate in unison relative to the fixed socket 182 and urge the abutting part 184 and the transmission axle 176 to rotate therewith relative to the fixed socket 182 via the contact between the end 179A or 179B of the spring 179 with the flange surface 184A or 184B of the abutting part 184. The transmission axle 176 in turn can drive the collar 174 and the limiting part 164 to rotate in unison, which can cause the limiting part 164 to slide on the threaded portion 160. When the position of the limiting part 164 is to be adjusted, a user can remove the end cap 111A so as to expose the adjusting part 180, and then rotate the adjusting part 180 as described previously.

Figure 45:
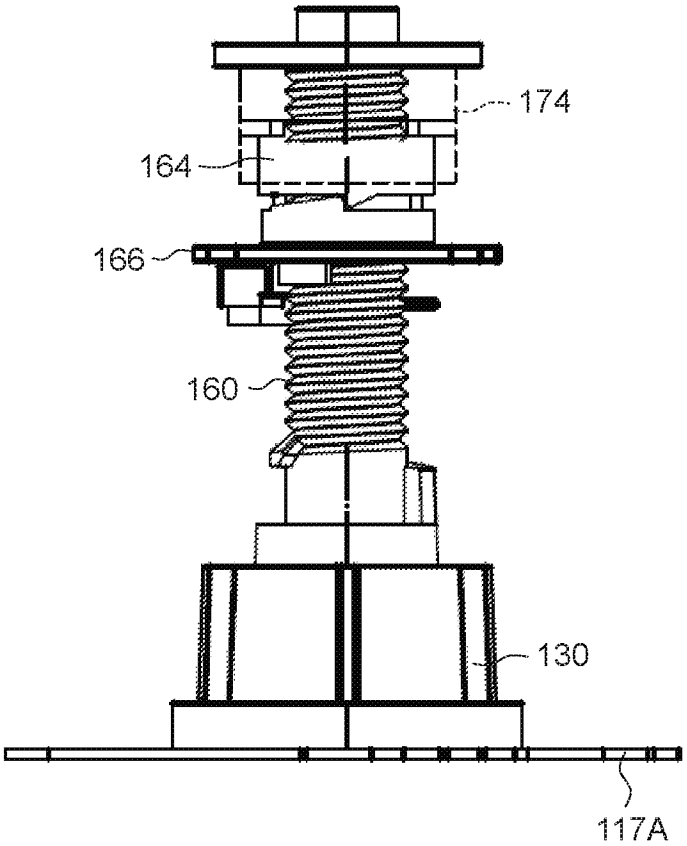
FIG. 45 is a schematic view illustrating a configuration of the limiting mechanism when the bottom part is in the desirable highest position shown in FIG. 44.
Figure 44:
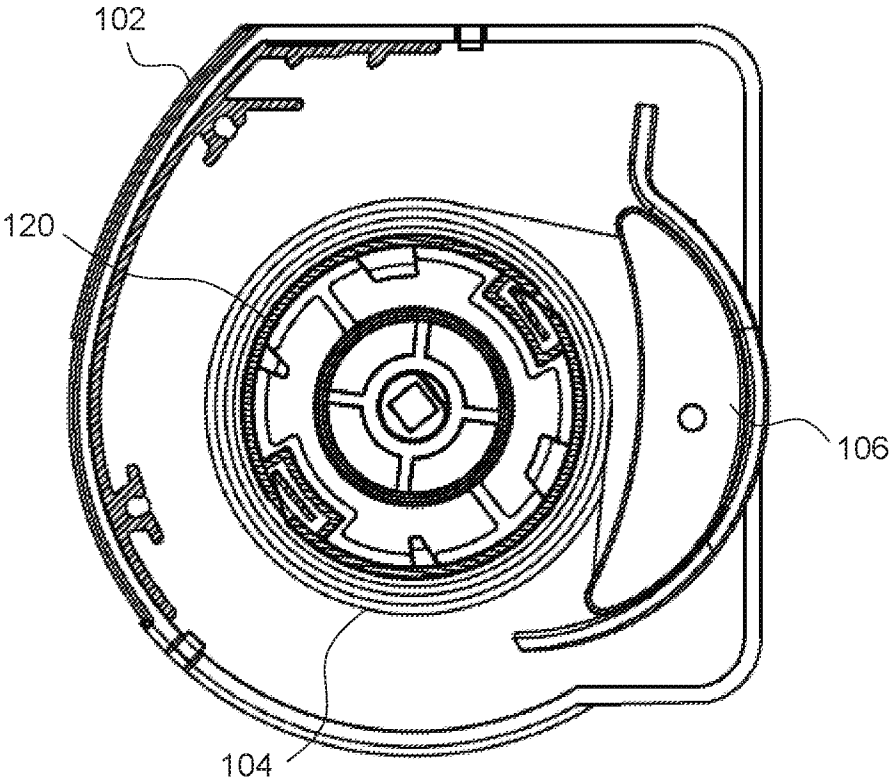
FIG. 44 is a schematic view illustrating the bottom part of the window shade in a desirable highest position.
Figure 47:
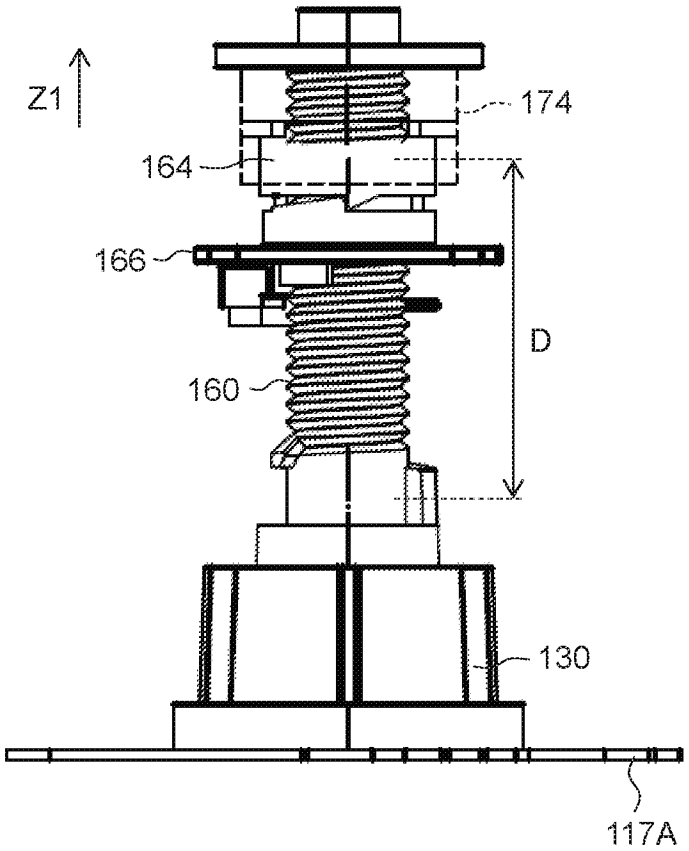
FIG. 47 is a side view illustrating the limiting mechanism when the bottom part is in the actual highest position shown in FIG. 46.
Figure 46:
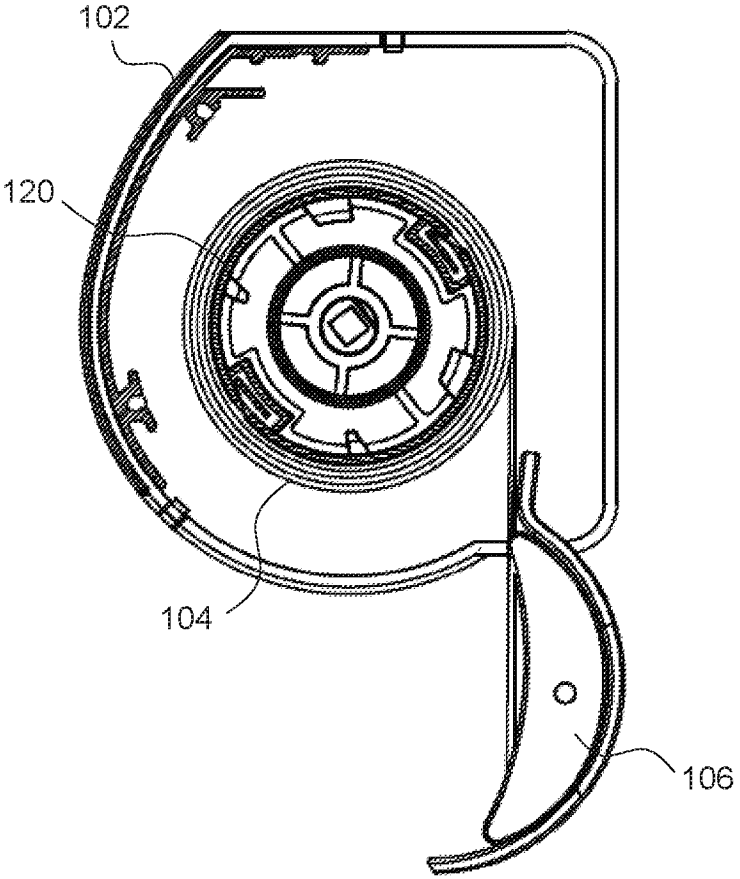
FIG. 46 is a schematic view illustrating the window shade having an actual highest position of the bottom part that is lower than the desirable highest position shown in FIG. 44.
Figure 49:
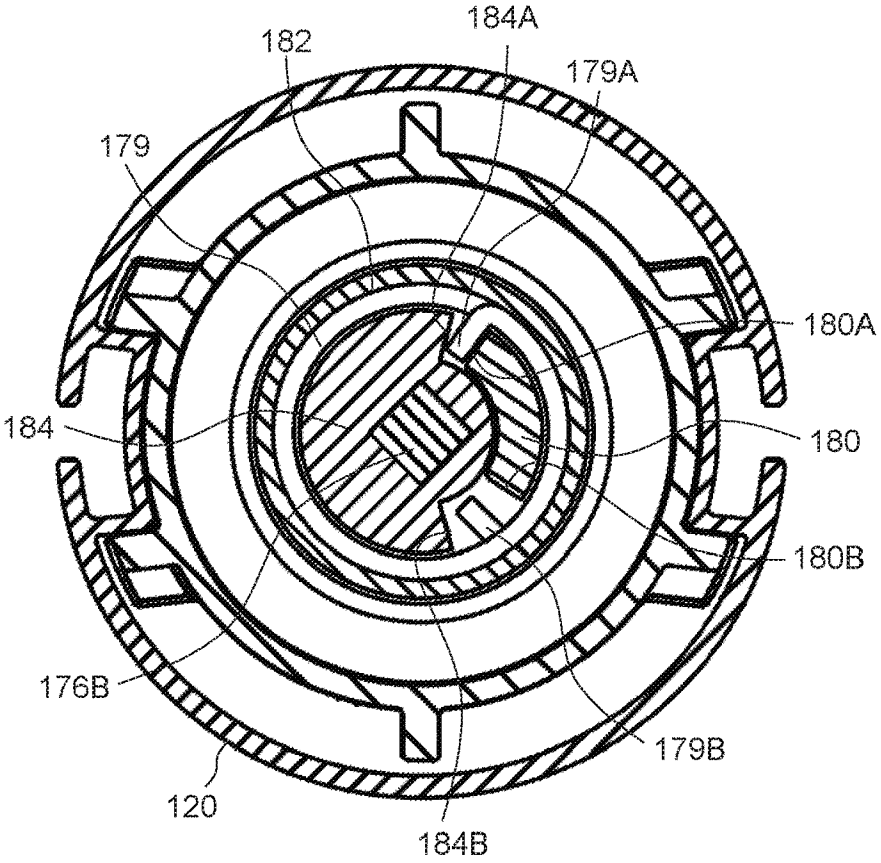
FIG. 49 is a schematic view illustrating exemplary adjustment of the limit setting assembly in a first direction.
Figure 48:
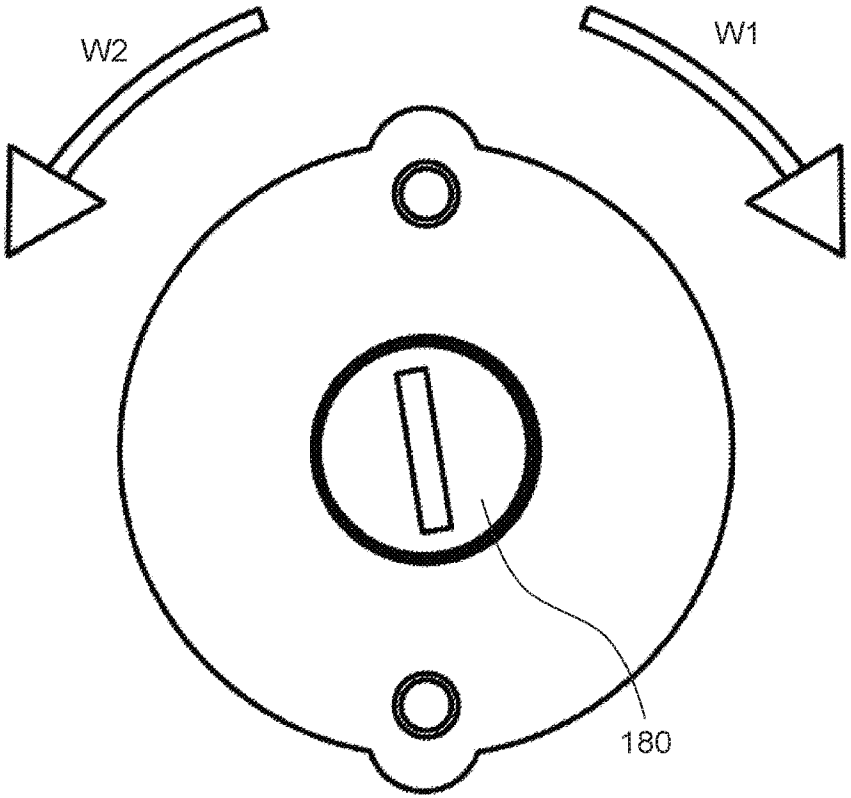
FIG. 48 is a schematic view illustrating exemplary operation of an adjusting part provided in the limit setting assembly.

In conjunction with FIGS. 6, 24-27 and 43, reference is made hereinafter to FIGS. 44-52 to describe exemplary operation of the limit setting assembly 172. FIG. 44 exemplary illustrates a desirable highest position for the bottom part 106, and FIG. 45 illustrates a corresponding configuration of the limiting mechanism 124. Assuming that an actual highest position of the bottom part 106 is as shown in FIG. 46 and is lower than the desirable highest position shown in FIG. 44, this corresponds to a configuration in which the travel range of the follower 166 partially delimited by the limiting part 164 may not be sufficiently long. Accordingly, there is a need to increase a distance D between the stop portion 162 and the limiting part 164, as illustrated in FIG. 47. Referring to FIGS. 48 and 49, for adjusting the position of the limiting part 164, a user can rotate the adjusting part 180 in a direction W1. This rotational displacement of the adjusting part 180 can urge the arrester 178, the abutting part 184, the transmission axle 176, the collar 174 and the limiting part 164 to rotate in unison in the same direction W1 owing to the contact between the flange surface 180A of the adjusting part 180 and the end 179A of the spring 179 and the contact between the end 179A of the spring 179 and the flange surface 184A of the abutting part 184, as shown in FIG. 49. As a result, the limiting part 164 can slide along the threaded portion 160 in the direction Z1 (better shown in FIG. 47) for increasing the distance D.

Figure 51:
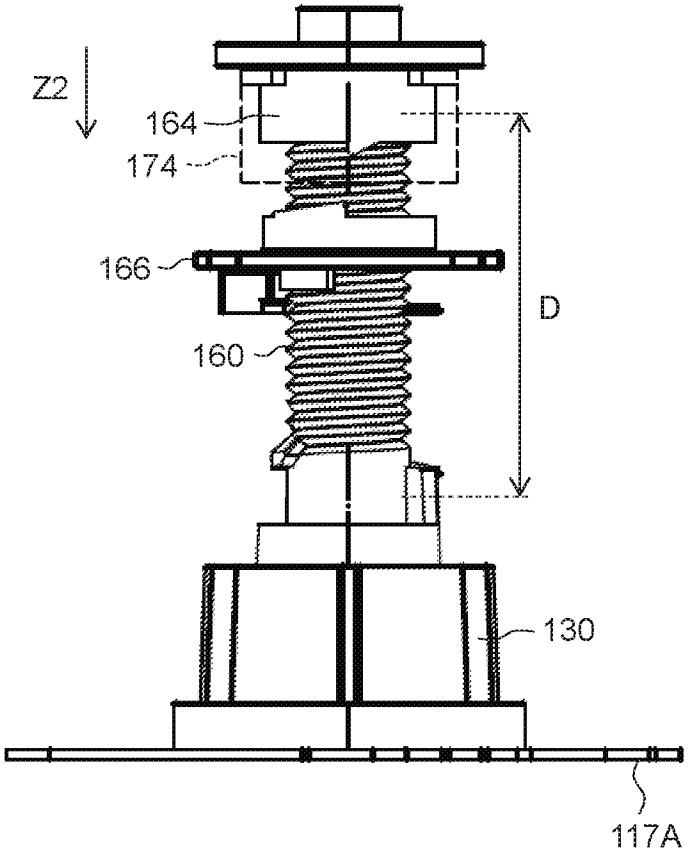
FIG. 51 is a side view illustrating the limiting mechanism when the bottom part is in the actual highest position shown in FIG. 50.
Figure 50:
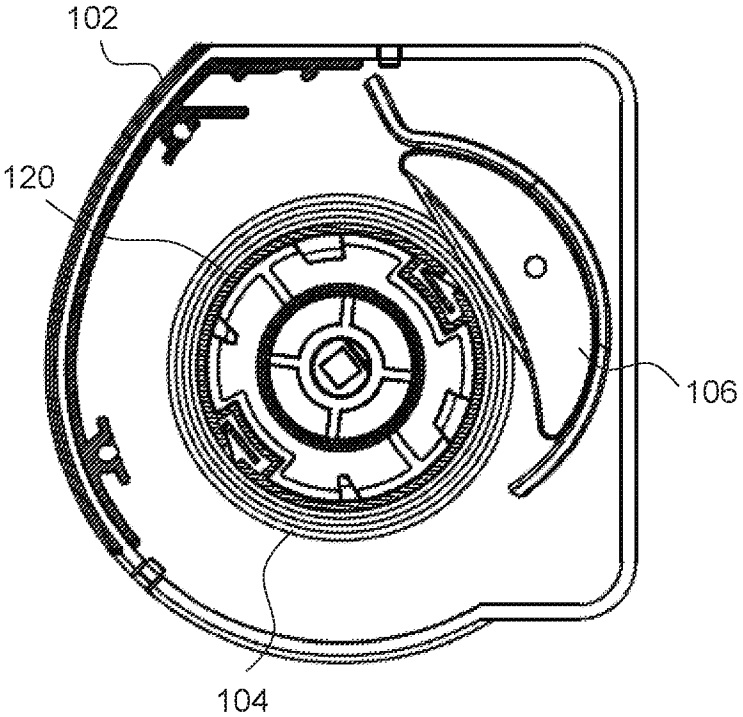
FIG. 50 is a schematic view illustrating the window shade having an actual highest position of the bottom part that is higher than the desirable highest position shown in FIG. 44.
Figure 52:
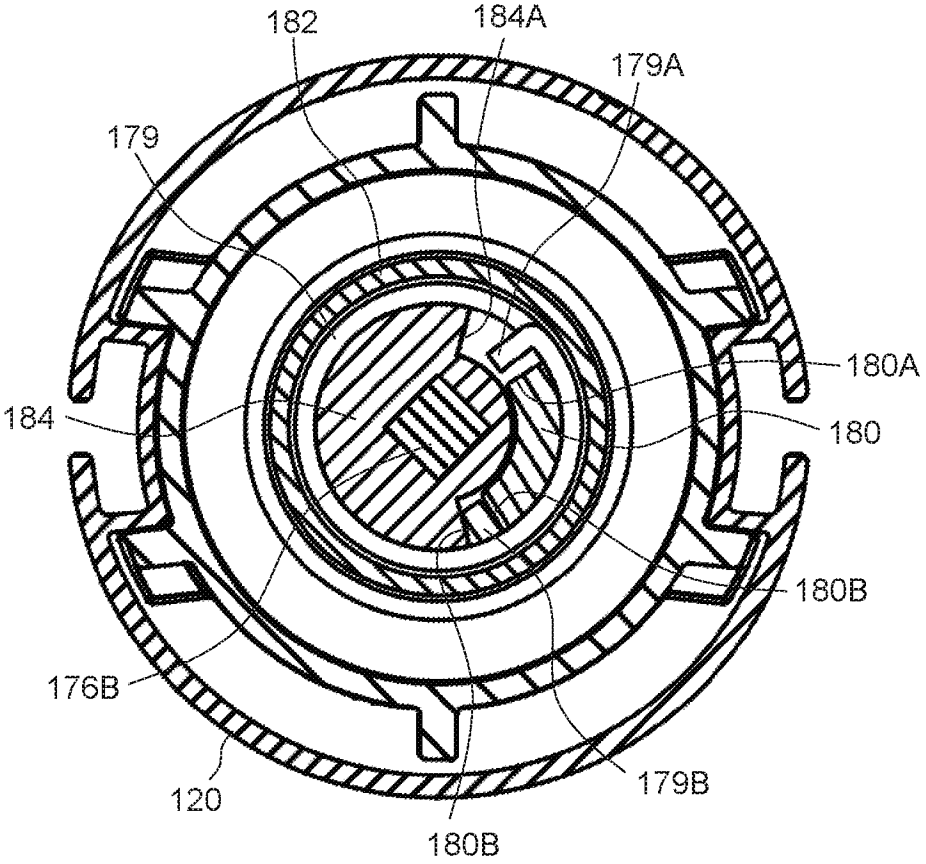
FIG. 52 is a schematic view illustrating exemplary adjustment of the limit setting assembly in a second direction.

Referring to FIGS. 50 and 51, assuming that an actual highest position of the bottom part 106 is as shown in FIG. 50 and is higher than the desirable highest position shown in FIG. 44, this corresponds to a configuration in which the travel range of the follower 166 partially delimited by the limiting part 164 may be too long. For example, this travel range may be so excessive that the follower 166 may even be unable to reach the limiting part 164. Accordingly, there is a need to reduce a distance D between the stop portion 162 and the limiting part 164, as illustrated in FIG. 51. Referring to FIGS. 48 and 52, for adjusting the position of the limiting part 164, a user can rotate the adjusting part 180 in a direction W2. This rotational displacement of the adjusting part 180 can urge the arrester 178, the abutting part 184, the transmission axle 176, the collar 174 and the limiting part 164 to rotate in unison in the same direction W2 owing to the contact between the flange surface 180B of the adjusting part 180 and the end 179B of the spring 179 and the contact between the end 179B of the spring 179 and the flange surface 184B of the abutting part 184, as shown in FIG. 52. As a result, the limiting part 164 can slide along the threaded portion 160 in the direction Z2 for reducing the distance D.

Although the limit setting assembly 172 described herein can offer the advantageous feature of adjusting a highest position of the bottom part 106, it will be appreciated that other embodiments of the window shade may omit the limit setting assembly 172. In embodiments without the limit setting assembly 172, the limiting part 164 may be fixedly assembled (e.g., the limiting part 164 may be fixedly attached to the threaded portion 160 via a fastener), and the limiting mechanism 124 can still operate like previously described.

The structures described herein use an actuating system that can delimit a vertical travel range of the shading structure in an accurate manner, allow convenient adjustment according to a size of the window shade, and prevent erroneous manipulation of the window shade. While the shading structure is fully extended downward, a user can lock the shading structure in an open state with a simple operating step by rotating the bottom part. The actuating system described herein is simple to operate, and has a compact size allowing convenient assembly in the head rail of the window shade.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A window shade comprising:

a head rail fixedly connected with a support shaft;

a shading structure including a first and a second suspending part, each of the first and second suspending parts respectively having a first end and a second end opposite to each other;

a rotary drum pivotally connected with the support shaft and respectively affixed with the first ends of the first and second suspending parts, the rotary drum being rotatable in a first direction for winding the shading structure around the rotary drum and in a second direction opposite to the first direction for unwinding the shading structure from the rotary drum;

a bottom part respectively connected with the second ends of the first and second suspending parts;

a spring unit connected with the rotary drum, the spring unit being operable to bias the rotary drum in rotation in the first direction; and a limiting mechanism respectively connected with the support shaft and the rotary drum, the limiting mechanism having an unlocking state and a locking state, the unlocking state of the limiting mechanism allowing rotation of the rotary drum in the first and second directions, and the locking state of the limiting mechanism preventing rotation of the rotary drum in the first direction, wherein the limiting mechanism is switchable from the unlocking state to the locking state by a limited rotational displacement of the rotary drum in the second direction while the shading structure is fully extended from the rotary drum;

wherein the limiting mechanism comprises a follower and a stop portion, the stop portion being fixedly connected with the support shaft, and the follower being respectively connected with the rotary drum and the support shaft so that the follower is rotationally coupled to the rotary drum and is slidable axially relative to the rotary drum, the follower having a resilient arm, the resilient arm and the follower being movable in unison during rotation and sliding movements of the follower, wherein the follower is movable along the support shaft between a first and a second position, most of the shading structure being wound around the rotary drum when the follower is in the first position and the shading structure being fully extended from the rotary drum when the follower is in the second position, the locking state of the limiting mechanism corresponding to a configuration in which the follower is in the second position and the resilient arm is engaged with the stop portion, the resilient arm being disengaged from the stop portion when the limiting mechanism is in the unlocking state; and wherein the support shaft includes a first and a second sidewall surface, the first sidewall surface being adapted to push the resilient arm to deflect for facilitating engagement of the resilient arm with the stop portion, and the second sidewall surface being spaced apart from the stop portion and adapted to push the resilient arm to deflect for facilitating disengagement of the resilient arm from the stop portion.

2. The window shade according to claim 1, wherein the limiting mechanism is switchable from the locking state to the unlocking state by another limited rotational displacement of the rotary drum in the second direction that causes the second sidewall surface to push the resilient arm to deflect for facilitating disengagement of the resilient arm from the stop portion.

3. The window shade according to claim 1, wherein the support shaft and the follower are disposed inside the rotary drum.

4. The window shade according to claim 1, wherein the rotary drum is pivotally connected with the support shaft about a pivot axis, and the follower is slidable along the pivot axis.

5. The window shade according to claim 1, wherein the engagement of the stop portion with the follower in the second position prevents the follower from moving from the second position toward the first position.

6. The window shade according to claim 1, wherein the support shaft includes a threaded portion, the stop portion being located adjacent to an end of the threaded portion, and the follower being engaged with the threaded portion so that a rotation of the rotary drum causes the follower to rotate and slide along the threaded portion.

7. The window shade according to claim 1, wherein the limiting mechanism further comprises a limiting part assembled with the support shaft, a contact between the limiting part and the follower stopping the follower in the first position.

8. The window shade according to claim 7, wherein the support shaft includes a threaded portion, the stop portion being located adjacent to a first end of the threaded portion, the limiting part being engaged with the threaded portion adjacent to a second end of the threaded portion opposite to the first end, the follower being engaged with the limiting part in the first position.

9. The window shade according to claim 8, wherein the limiting part, the support shaft and the stop portion are disposed inside the rotary drum.

10. The window shade according to claim 8, wherein the limiting mechanism further comprises a limit setting assembly operable to adjust a position of the limiting part on the threaded portion, the limit setting assembly comprising a collar and a transmission axle fixedly connected with each other, the collar being disposed adjacent to the second end of the threaded portion, the limiting part being rotationally coupled to the collar and slidable on the threaded portion relative to the collar, the transmission axle and the collar being rotatable in unison relative to the support shaft for driving the limiting part to slide on the threaded portion.

11. The window shade according to claim 10, wherein the support shaft has a hollow interior, and the transmission axle extends through the hollow interior of the support shaft.

12. The window shade according to claim 10, further comprising a fixed socket fixedly connected with the support shaft, and the limit setting assembly further comprising an arrester and an adjusting part, the arrester being disposed inside the fixed socket and being connectible with an abutting part of the transmission axle, and the adjusting part being pivotally connected with the fixed socket, wherein the arrester has a locking state and a release state, the locking state of the arrester preventing a displacement of the transmission axle, the collar and the limiting part that is induced by a contact between the follower and the limiting part, and the adjusting part being rotatable to urge the arrester to switch from the locking state to the release state for adjusting the position of the limiting part on the threaded portion.

13. The window shade according to claim 12, wherein the support shaft includes an enlarged portion, the threaded portion having a diameter that is smaller than a diameter of the enlarged portion, the threaded portion extending from a side of the enlarged portion, and the arrester and the fixed socket being disposed in a hollow interior of the enlarged portion.

14. The window shade according to claim 13, wherein the enlarged portion of the support shaft pivotally supports an end of the rotary drum.

15. The window shade according to claim 12, wherein the arrester comprises a spring disposed inside the fixed socket, a frictional contact between the spring and the fixed socket preventing a rotational displacement of the transmission axle, the collar and the limiting part that is induced by a contact between the follower and the limiting part, and the adjusting part being rotatable to urge the spring to loosen the frictional contact between the spring and the fixed socket and to further urge the loosened spring, the transmission axle and the collar to rotate in unison for driving the limiting part to slide on the threaded portion.

16. The window shade according to claim 1, wherein the spring unit comprises a torsion spring disposed around a shaft assembly, the shaft assembly being rotatable for adjusting a biasing force applied by the torsion spring on the rotary drum.

17. The window shade according to claim 16, further comprising a spring adjustment mechanism operable to adjust a biasing force applied by the torsion spring on the rotary drum, wherein the spring adjustment mechanism comprises an arrester and an adjusting part, the head rail being fixedly connected with a fixed socket, the arrester being disposed inside the fixed socket and being connectable with an abutting part of the shaft assembly, and the adjusting part being pivotally connected with the fixed socket, wherein the arrester has a locking state and a release state, the locking state of the arrester preventing a rotation of the shaft assembly that is induced by the biasing force applied by the torsion spring, and the adjusting part being rotatable to urge the arrester to switch from the locking state to the release state and to further urge the arrester and the shaft assembly to rotate in unison in the same direction.

18. The window shade according to claim 17, wherein the arrester comprises a spring disposed inside the fixed socket, a frictional contact between the spring and the fixed socket preventing a rotation of the shaft assembly that is induced by the biasing force applied by the torsion spring, and the adjusting part being rotatable to urge the spring to loosen the frictional contact between the spring and the fixed socket and to further urge the loosened spring and the shaft assembly to rotate in unison in the same direction.

19. The window shade according to claim 1, wherein the first and second suspending parts are respectively a first and a second panel, and the shading structure further comprises a plurality of transversal vanes respectively connected with the first and second panels, the transversal vanes being oriented generally horizontally when the limiting mechanism is in the locking state.

20. A window shade comprising:

a head rail fixedly connected with a support shaft including a threaded portion;

a shading structure including a first and a second suspending part, each of the first and second suspending parts respectively having a first end and a second end opposite to each other;

a rotary drum pivotally connected with the support shaft and respectively affixed with the first ends of the first and second suspending parts, the rotary drum being rotatable in a first direction for winding the shading structure around the rotary drum and in a second direction opposite to the first direction for unwinding the shading structure from the rotary drum;

a bottom part respectively connected with the second ends of the first and second suspending parts;

a spring unit connected with the rotary drum, the spring unit being operable to bias the rotary drum in rotation in the first direction; and a limiting mechanism respectively connected with the support shaft and the rotary drum, the limiting mechanism having an unlocking state and a locking state, the unlocking state of the limiting mechanism allowing rotation of the rotary drum in the first and second directions, and the locking state of the limiting mechanism preventing rotation of the rotary drum in the first direction, wherein the limiting mechanism is switchable from the unlocking state to the locking state by a limited rotational displacement of the rotary drum in the second direction while the shading structure is fully extended from the rotary drum;

wherein the limiting mechanism comprises a follower, a stop portion and a limiting part, the stop portion being fixedly connected with the support shaft and located adjacent to a first end of the threaded portion, the limiting part being engaged with the threaded portion adjacent to a second end of the threaded portion opposite to the first end, and the follower being connected with the support shaft, wherein the follower is movable along the support shaft between a first and a second position, most of the shading structure being wound around the rotary drum when the follower is in the first position and the shading structure being fully extended from the rotary drum when the follower is in the second position, the follower being stopped in the first position by engaging with the limiting part, the locking state of the limiting mechanism corresponding to a configuration in which the follower is in the second position and is engaged with the stop portion;

the limiting mechanism further comprising a limit setting assembly operable to adjust a position of the limiting part on the threaded portion, the limit setting assembly comprising a collar and a transmission axle fixedly connected with each other, the collar being disposed adjacent to the second end of the threaded portion, the limiting part being rotationally coupled to the collar and slidable on the threaded portion relative to the collar, the transmission axle and the collar being rotatable in unison relative to the support shaft for driving the limiting part to slide on the threaded portion.

21. The window shade according to claim 20, wherein the support shaft has a hollow interior, and the transmission axle extends through the hollow interior of the support shaft.

22. The window shade according to claim 20, further comprising a fixed socket fixedly connected with the support shaft, and the limit setting assembly further comprising an arrester and an adjusting part, the arrester being disposed inside the fixed socket and being connectible with an abutting part of the transmission axle, and the adjusting part being pivotally connected with the fixed socket, wherein the arrester has a locking state and a release state, the locking state of the arrester preventing a displacement of the transmission axle, the collar and the limiting part that is induced by a contact between the follower and the limiting part, and the adjusting part being rotatable to urge the arrester to switch from the locking state to the release state for adjusting the position of the limiting part on the threaded portion.

23. The window shade according to claim 22, wherein the support shaft includes an enlarged portion, the threaded portion having a diameter that is smaller than a diameter of the enlarged portion, the threaded portion extending from a side of the enlarged portion, and the arrester and the fixed socket being disposed in a hollow interior of the enlarged portion.

24. The window shade according to claim 23, wherein the enlarged portion of the support shaft pivotally supports an end of the rotary drum.

25. The window shade according to claim 22, wherein the arrester comprises a spring disposed inside the fixed socket, a frictional contact between the spring and the fixed socket preventing a rotational displacement of the transmission axle, the collar and the limiting part that is induced by a contact between the follower and the limiting part, and the adjusting part being rotatable to urge the spring to loosen the frictional contact between the spring and the fixed socket and to further urge the loosened spring, the transmission axle and the collar to rotate in unison for driving the limiting part to slide on the threaded portion.

26. A window shade comprising:

a head rail fixedly connected with a support shaft;

a shading structure including a first and a second suspending part, each of the first and second suspending parts respectively having a first end and a second end opposite to each other;

a rotary drum pivotally connected with the support shaft and respectively affixed with the first ends of the first and second suspending parts, the rotary drum being rotatable in a first direction for winding the shading structure around the rotary drum and in a second direction opposite to the first direction for unwinding the shading structure from the rotary drum;

a bottom part respectively connected with the second ends of the first and second suspending parts;

a spring unit connected with the rotary drum, the spring unit being operable to bias the rotary drum in rotation in the first direction, wherein the spring unit comprises a torsion spring disposed around a shaft assembly, the shaft assembly being rotatable for adjusting a biasing force applied by the torsion spring on the rotary drum;

a limiting mechanism respectively connected with the support shaft and the rotary drum, the limiting mechanism having an unlocking state and a locking state, the unlocking state of the limiting mechanism allowing rotation of the rotary drum in the first and second directions, and the locking state of the limiting mechanism preventing rotation of the rotary drum in the first direction, wherein the limiting mechanism is switchable from the unlocking state to the locking state by a limited rotational displacement of the rotary drum in the second direction while the shading structure is fully extended from the rotary drum; and a spring adjustment mechanism operable to adjust a biasing force applied by the torsion spring on the rotary drum, wherein the spring adjustment mechanism comprises an arrester and an adjusting part, the head rail being fixedly connected with a fixed socket, the arrester being disposed inside the fixed socket and being connectible with an abutting part of the shaft assembly, and the adjusting part being pivotally connected with the fixed socket, wherein the arrester has a locking state and a release state, the locking state of the arrester preventing a rotation of the shaft assembly that is induced by the biasing force applied by the torsion spring, and the adjusting part being rotatable to urge the arrester to switch from the locking state to the release state and to further urge the arrester and the shaft assembly to rotate in unison in the same direction.

27. The window shade according to claim 26, wherein the arrester comprises a spring disposed inside the fixed socket, a frictional contact between the spring and the fixed socket preventing a rotation of the shaft assembly that is induced by the biasing force applied by the torsion spring, and the adjusting part being rotatable to urge the spring to loosen the frictional contact between the spring and the fixed socket and to further urge the loosened spring and the shaft assembly to rotate in unison in the same direction.

* * * * *